US009200423B2

(12) United States Patent
Helbig et al.

(10) Patent No.: US 9,200,423 B2
(45) Date of Patent: Dec. 1, 2015

(54) CLEANING VEHICLE, VEHICLE SYSTEM AND METHOD

(75) Inventors: Courtland Joshua Helbig, Morgantown, WV (US); Michael Robert Meyers, Mountain Lake Park, MD (US); Reuben Jay Ruggiero, Accident, MD (US)

(73) Assignee: GMS Mine Repair and Maintenance, Inc., Mountain Lake Park, MD (US)

( * ) Notice: Subject to any disclaimer, the term of this patent is extended or adjusted under 35 U.S.C. 154(b) by 527 days.

(21) Appl. No.: 13/458,103

(22) Filed: Apr. 27, 2012

(65) Prior Publication Data

US 2012/0305025 A1 Dec. 6, 2012

Related U.S. Application Data

(60) Provisional application No. 61/493,971, filed on Jun. 6, 2011.

(51) Int. Cl.

| | |
|---|---|
| ***E21F 17/00*** | (2006.01) |
| ***E02F 3/34*** | (2006.01) |
| ***E02F 3/36*** | (2006.01) |
| ***E02F 3/78*** | (2006.01) |
| ***E02F 3/96*** | (2006.01) |

(Continued)

(52) U.S. Cl.

CPC ..... *E02F 3/34* (2013.01); *E02F 3/3631* (2013.01); *E02F 3/3636* (2013.01); *E02F 3/783* (2013.01); *E02F 3/96* (2013.01); *E02F 3/962* (2013.01); *E02F 9/02* (2013.01); *E02F 9/0875* (2013.01); *E02F 9/205* (2013.01)

(58) Field of Classification Search

CPC ..... E02F 9/205

USPC ..... 299/30, 66, 67

See application file for complete search history.

(56) References Cited

U.S. PATENT DOCUMENTS 3,335,881 A * 8/1967 Pahlsjo ..... 414/681
3,779,408 A * 12/1973 Ivie ..... 299/64

(Continued)

FOREIGN PATENT DOCUMENTS

EP 1391682 B1 6/2006
GB 2189278 10/1987

(Continued)

OTHER PUBLICATIONS

English abstract of EP1391682B1, Jun. 28, 2006.

(Continued)

*Primary Examiner* — John Kreck

(74) *Attorney, Agent, or Firm* — Porter Wright Morris and Arthur LLP

(57) ABSTRACT

A remotely-operable vehicle for cleaning material from beneath a structure. The vehicle includes a body having a front portion and a rear portion, a pair of support arms pivotally supported within the body, a drive system for moving the vehicle, a hydraulic system, a receiver for receiving control signals from a remote control device, a processor which generates signals for operating the drive system and the hydraulic system in response to received control signals, and at least one cleaning attachment removably attached to the vehicle at a proximal end of each support arm. A vehicle system as well as a method of cleaning coal from beneath a conveyor belt in a coal mine are also provided.

21 Claims, 23 Drawing Sheets

(51) Int. Cl.

| | |
|---|---|
| ***E02F 9/02*** | (2006.01) |
| ***E02F 9/08*** | (2006.01) |
| ***E02F 9/20*** | (2006.01) |

(56) References Cited

U.S. PATENT DOCUMENTS

| | | | | | |
|---|---|---|---|---|---|
| 3,896,571 | A | * | 7/1975 | Satterwhite | 299/67 |
| 3,951,459 | A | | 4/1976 | Honeycutt, Jr. | |
| 4,858,347 | A | * | 8/1989 | Hanson et al. | 299/64 |
| 4,895,476 | A | * | 1/1990 | Vangaever | 404/108 |
| 5,158,583 | A | * | 10/1992 | Bodin et al. | 299/1.4 |
| 5,423,654 | A | * | 6/1995 | Rohrbaugh | 414/686 |
| 5,975,644 | A | | 11/1999 | Lang | |
| 6,283,220 | B1 | * | 9/2001 | Carter | 169/24 |
| 6,619,177 | B1 | | 9/2003 | Hansen et al. | |
| 6,662,881 | B2 | * | 12/2003 | Domann | 172/272 |
| 7,089,733 | B1 | | 8/2006 | Jackson et al. | |
| 7,562,727 | B1 | * | 7/2009 | Hoffart | 180/9.1 |
| 7,914,249 | B2 | * | 3/2011 | Maynard et al. | 414/686 |
| 2004/0256908 | A1 | | 12/2004 | Risi | |
| 2007/0017713 | A1 | | 1/2007 | Sewell et al. | |
| 2010/0106344 | A1 | * | 4/2010 | Edwards et al. | 701/2 |
| 2010/0168933 | A1 | | 7/2010 | Rorabaugh | |
| 2010/0275472 | A1 | | 11/2010 | Cunningham | |
| 2011/0095249 | A1 | | 4/2011 | Collins | |

FOREIGN PATENT DOCUMENTS

| | | | |
|---|---|---|---|
| JP | 09025006 | * | 1/1997 |
| KR | 1020050016928 | | 2/2005 |
| WO | 2005012071 | | 2/2005 |
| WO | 2010138987 | | 9/2010 |

OTHER PUBLICATIONS

International Search Report for PCT/US2012/041077, Feb. 1, 2013.
Microtraxx MT 3234 Culvert Cleaning Vehicle, Rohmac Inc., Jan. 2010.

* cited by examiner

CLEANING VEHICLE, VEHICLE SYSTEM AND METHOD

CROSS REFERENCE TO RELATED APPLICATIONS

This application claims priority to U.S. Provisional Patent Application No. 61/493,971, filed on Jun. 6, 2011, entitled "Cleaning Vehicle and Method." The entire disclosure of the foregoing provisional patent application is incorporated by reference herein.

BACKGROUND

The present disclosure is related to a multi-purpose, low-profile vehicle and vehicle system.

Mining requires fastidious attention to safety, including clearing detritus and other materials from passageways and other locations. Clearing these materials, however, can be very labor intensive, and takes manpower away from mining activities. Also, mines can be very tight quarters with limited ventilation, thus preventing the use of conventional equipment for clearing and cleaning purposes.

In one specific example, mining operations often use conveyor systems for transporting mined product. By way of a more specific example, various types of conveyor belts are often used to transport coal within a mine. Over a period of time, detritus (e.g., coal slack) builds up underneath and around the conveyor system from spillage as well as from material carry-back on the return side (e.g., bottom) of the conveyor. Two to three feet (or more) of material may build up and compact under the main belts in a coal mine over one or more years of operation. This compacted material eventually needs to be excavated or cleaned-out in order to assure proper belt clearance, ensure miner safety, and for other purposes (e.g., to allow room for square sets in areas that they are required for ground control).

The coal slack and other material which builds up under and around conveyor systems is typically removed manually using shovels, air-powered jack hammers, and similar manually-operated implements. In some instances, each shift in a coal mine might have an entire crew (e.g., eight workers) devoted to cleaning beneath and around conveyor belts using various pneumatic and hand tools to manually excavate the material and load it back onto the belt. This can be a dangerous process, since the conveyor system will often be running as the material is manually cleaned from beneath a running conveyor. This manual process causes many lost time injuries, particularly back injuries, due to the labor intensive nature of the work and the fact that workers are required to work beneath a running conveyor belt.

While a variety of devices and techniques may exist for cleaning debris (such as material from beneath and around conveyor systems, e.g., in a coal mine), it is believed that no one prior to the inventors have made or used an invention as described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings.

Figure 1:
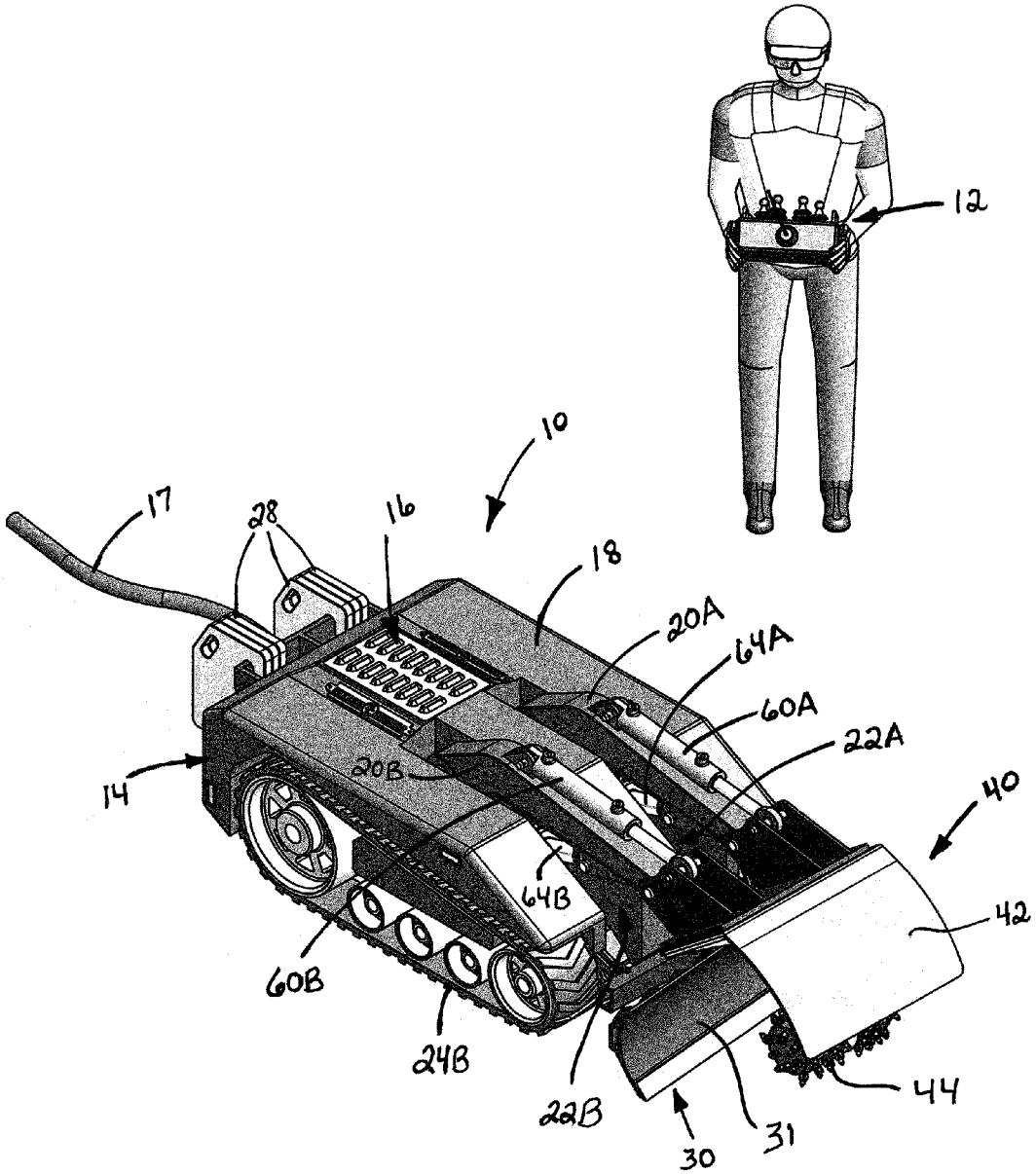
FIG. 1 is a perspective view of a cleaning vehicle and an operator controlling the vehicle using a remote control unit.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples should not be used to limit the scope of the present invention. Other features, aspects, and advantages of the versions disclosed herein will become apparent to those skilled in the art from the following description, which is by way of illustration, one of the best modes contemplated for carrying out the invention. As will be realized, the versions described herein are capable of other different and obvious aspects, all without departing from the invention. Accordingly, the drawings and descriptions should be regarded as illustrative in nature and not restrictive.

Embodiments described herein provide a multi-purpose, low-profile vehicle and vehicle system. A method for cleaning material from beneath and around a conveyor system (e.g., a conveyor belt, such as found in a coal mine) using the vehicle and vehicle system is also provided. In some embodiments, the vehicle is air-powered and/or remote controlled, allowing the operator to remain a safe distance from the conveyor belt or other area being cleaned. This allows the cleaning operation (or other tasks) to be performed more safely and more efficiently (i.e., with less manpower) as compared to conventional, manual cleaning. Some embodiments of the vehicle are also configured to provide a robust configuration designed to reduce potential damage to vehicle components during use, such as by reducing the likelihood that hydraulic hoses and/or connectors will be dislodged or damaged during use in mining environments and the like.

By way of one specific example, the vehicle described herein may be used to dislodge compacted material (e.g., coal slack) from beneath a conveyor belt in a coal mine, collect the dislodged material and deposit it back onto the conveyor belt (or deliver it to some other desired location). One exemplary method of use is to remotely (i.e., using a remote control device) drive the vehicle beneath a conveyor belt beneath which coal has collected, and then remotely manipulate the cleaning attachment (e.g., urging a rotating cutting head against the coal, lifting a bucket so as to scoop of coal therein, moving a rotating cutting head in side-to-side and/or up and down fashion against compacted coal, etc.) so as to dislodge the coal beneath the conveyor belt (e.g., cut up compacted coal for later removal, scoop up coal in a bucket, push coal from beneath the conveyor belt using a plow attachment, etc.).

One specific, non-limiting example is a remotely-operable vehicle or vehicle system for cleaning material from beneath a structure. The vehicle includes:

- a body having a front portion and a rear portion, wherein the front portion of the body includes a pair of support arm receiving slots, each of the slots extending rearwardly from the front end of the body (e.g., to a distal end wall of the front portion of the body;
- a pair of support arms, each support arm pivotally supported at its distal end within one of the slots, the support arms being at least partially retractable into the slots;
- a pair of hydraulic actuators associated with each of the support arms, each pair including upper and lower actuators, wherein the upper actuators are configured for effecting pivotal movement of a cleaning attachment affixed to proximal ends of the support arms, and the lower actuators are configured for raising and lowering the support arms;
- a pair of separately drivable drive tracks operatively mounted to the body, each having an associated drive motor (e.g., to not only move the vehicle forward and reverse, but also turn the vehicle by driving the motors at different speeds and/or in different directions);
- a hydraulic system having a hydraulic fluid tank, a hydraulic fluid pump, and a plurality of control valves, wherein the hydraulic fluid pump is in fluid communication with the tank and control valves, and supplies pressurized hydraulic fluid from the tank to the control vales for distribution to the drive motors and the actuators (and optionally to one or more cleaning attachments mounted on or operatively attached to the vehicle);
- a processor which generates signals for operating the drive system and the hydraulic system in response to control signals which the vehicle receives from a remote control device; and
- at least one cleaning attachment removably attached to the vehicle at a proximal end of each support arm, wherein the at least one cleaning attachment is configured to be manipulated remotely by a user using a remote control device.

The vehicle system may comprise, for example, the above-described vehicle along with a remote control device for operating the vehicle (including manipulating the attachment, in some embodiments. The remote control device is configured to allow a user to transmit control signals from the remote control device to the vehicle for controllably driving the vehicle as well as controllably manipulating the support arms, and optionally a cleaning attachment itself.

Figure 2:
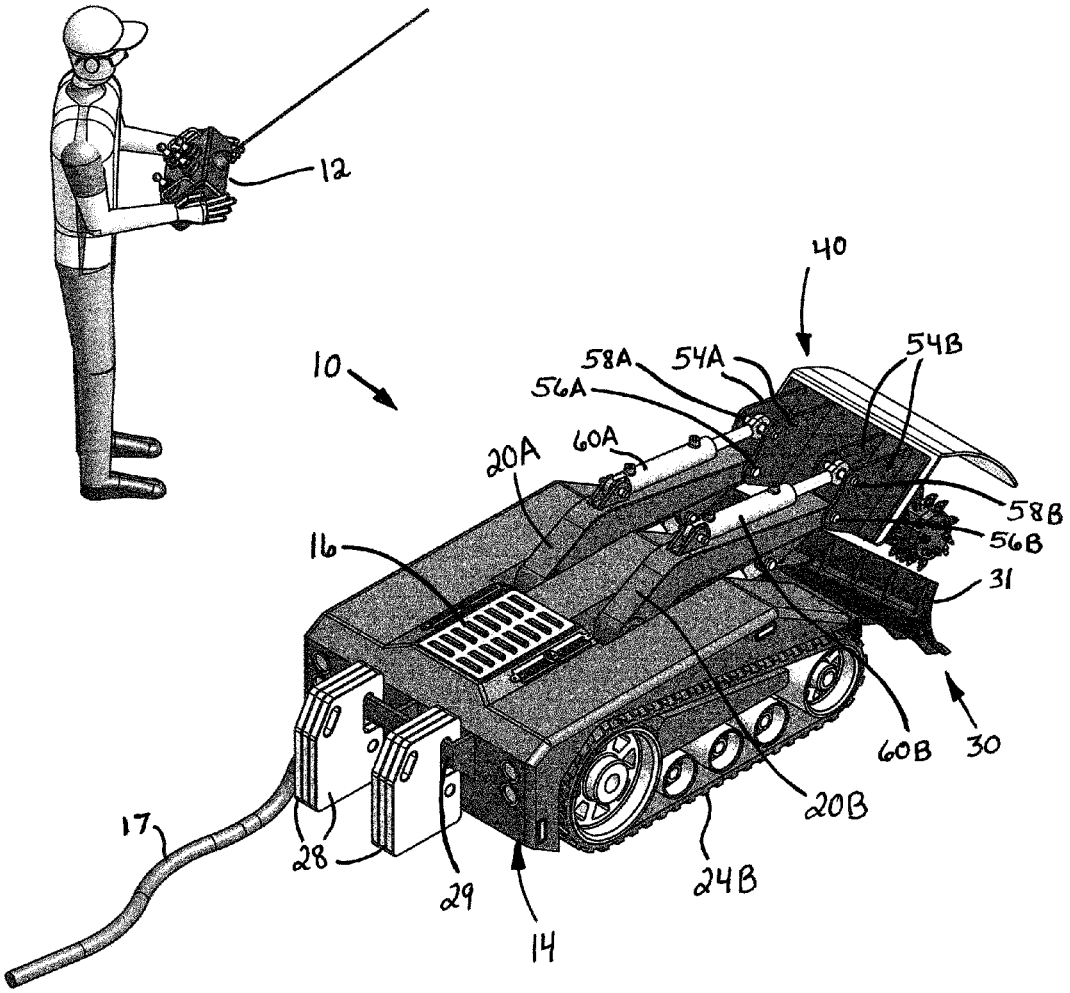
FIG. 2 is another perspective view of the cleaning vehicle of FIG. 1.

FIGS. 1 and 2 depict one embodiment of a cleaning vehicle (10) which may be used, for example, in cleaning beneath and/or around a conveyor belt in a mine. Vehicle (10) is configured to be operated remotely by a user manipulating remote control unit (12).

Vehicle (10) also comprises one component of a vehicle system. Other components of the system include two or more attachments, such as cleaning, cutting or material handling attachments, which may be attached to and removed from vehicle (10) by a user. In some embodiments of the vehicle system, more than one such removable attachment may be attached to vehicle (10) at the same time. In addition, one or more of the attachments may be configured for operative attachment to vehicle (10) such that the attachment may be manipulated by a user, such as through the use of remote control unit (12). As further described herein, vehicle (10) includes mounting features which facilitate mounting of the attachments to vehicle (10).

Remote control unit (12) communicates with a control system on vehicle (10), wherein the vehicle control system includes a receiver (which may comprise a transceiver) located within (or, in another embodiment, in) vehicle (10) for receiving control signals transmitted by remote control unit (12). Remote control unit (12) includes a transmitter (which may comprise a transceiver) for transmitting vehicle control signals from remote control unit (12) to the control system of vehicle (10).

Remote control unit (12) and the vehicle control system provide multi-channel control whereby remote control unit (12) is used to control a plurality of vehicle functions. As used herein, unless otherwise indicated, "channel" refers to a control function associated with a control signal sent by remote control unit (12) to vehicle (10), wherein the vehicle control system decodes the signal to determine which control function the signal pertains to (e.g., vehicle speed, steering, lift actuators, etc.). In the embodiment of FIG. 1, remote control unit (12) communicates with the control system of vehicle (10) over a single frequency. In alternative embodiments, remote control unit (12) communicates with the vehicle control system over a plurality of frequencies.

The vehicle control system, which includes one or more processors (e.g., a microprocessor or microcontroller), receives the control signals from remote control unit (12). These signals are processed and used to control the operation of vehicle (10), which may include one or more attachments mounted thereto. The control signals received by the vehicle control system may be used to control, for example, the speed and movement (e.g., turning) of the vehicle (10), as well as one or more of a variety of devices within or attached to vehicle (10). By way of example, a microprocessor receives and decodes control signals received from remote control unit (12), and generates signals used to drive one or more servo motors, valves (e.g., solenoid valves), lights or various other components of vehicle (10), and optionally attachments operatively mounted on vehicle (10). By way of specific example, controls signals may cause hydraulic solenoid valves to open causing hydraulic fluid to flow into actuators used to lift support arms (further described herein).

Although remote control unit (12) is depicted as communicating wirelessly with vehicle (10) (e.g., using RF signals), a wired connection may alternatively be provided between remote control unit (12) and vehicle (10). In such an embodiment, control signals may be transmitted directly between remote control unit (12) and one or more processors of the vehicle control system.

Remote control unit (12) includes a plurality of input devices such as one or more control levers, switches, control sticks, buttons, keys and/or other input devices, as is known to those skilled in the art. Each input device may be assigned (i.e., associated with) a particular vehicle function (e.g., controlling the speed of vehicle (10)), and the assigned function may be predetermined or set (or changed) by the user before or during operation of vehicle (10).

The assigned function may also depend upon the attachment(s) mounted to vehicle (10), and be set by the user and/or automatically determined by remote control unit (12) and/or the vehicle control system based on the specific attachment(s) mounted to vehicle (10). The nature of the attachment (e.g., name, unique identifier, etc.) may be input by the user (e.g., using remote control unit (12)) or even detected by vehicle (10) and/or remote control unit (12) (e.g., an unique mechanical or electronic identifier on the attachment which is detected by the control system or other aspect of vehicle (10)).

As mentioned above, remote control unit (12) is configured to communicate with the receiver (e.g., a transceiver) of vehicle (10) via RF transmission. In some embodiments, remote control unit (12) includes a display screen and/or one or more operator-perceivable visual and/or audible indicators which indicate to the operator: (a) whether the remote control unit (12) is communicating properly with vehicle (10); (b) operational parameters concerning the operation of vehicle (10) (e.g., status of on-board power supply, temperatures, vehicle speed, etc.); (c) the position of one or more attachments mounted to vehicle (10); and (d) other information relevant to the operation and use of vehicle (10).

Vehicle (10) includes a body (14). It should be noted that the configuration of body (14) shown in FIG. 1 is merely exemplary of one embodiment, and any of a variety of other shapes and configurations may be used instead. In the example shown, and as further described herein for an alternative embodiment, body (14) comprises a tubular frame of weldments covered by heavy plate (e.g., steel plate) which forms the outer panels (i.e., outer surfaces) of body (14). Of course body (14) may be formed in a variety of other ways, such as a plurality of steel panels welded, riveted or otherwise attached to each other (such as a monocoque construction for all or a portion of body (14)).

Body (14) houses various components of vehicle (10), such as a drive unit (16) for effecting movement of vehicle (10), the vehicle control system, one or more power supplies (e.g., one or more batteries), hydraulics, and other components, as further described herein. Body (14) at least partially covers the drive tracks (24A, 24B) of vehicle (10), thus providing fenders on each side of body (14) which extend over and around the rear (or distal) end of drive tracks (24A, 24B), as shown.

In the exemplary embodiment shown, vehicle (10) is air-powered over hydraulic—compressed air is used to drive one or more hydraulic pumps in order to supply pressurized hydraulic fluid for purposes of not only controllably driving (i.e., moving and steering) the vehicle, but also for actuating and/or operating one or more attachments. Thus, vehicle (10) (e.g., body (14)) is configured such that a compressed air hose (17) may be operatively attached to vehicle (10) in order to provide compressed air to vehicle (10). A suitable coupling may be provided on vehicle (10) which is matingly couplable with a coupling provided on the end of an air hose (17) (see FIG. 1). It will be understood, however, that various other types of drive units and power sources may be used, such as a diesel-powered or electric-powered vehicle, or even a combination of two or more of air, diesel and electric power systems.

Details of one embodiment of an air-powered over hydraulic system and control scheme will described further herein with respect to vehicle (1010). In general, embodiments of the air-powered over hydraulic system comprises one or more reservoirs (also referred to as tanks) of hydraulic fluid, an hydraulic fluid cooling system, one or more fluid pumps for supplying pressurized hydraulic fluid, and a plurality of control valves (e.g., solenoid valves) that selectively supply pressurized hydraulic fluid to various fluid-actuated devices on the vehicle (e.g., drive motors and actuators such as hydraulic cylinders) as well as to hydraulic fluid couplings provided on vehicle (10).

The hydraulic fluid pump comprises a variable-displacement pump which is directly coupled to an air motor (i.e., pneumatic motor) driven by compressed air. In addition to driving the air motor, vehicle (10) may also be configured to include one or air couplings, such as on body (14). Compressed air from air hose (17) may be routed to these couplings such that one or more air-powered attachments (e.g., an air-powered drill) may be supplied with compressed air.

Hydraulic fluid couplings (not shown) are also provided on vehicle (10) and are configured to be operatively connected (e.g., via a hose attached thereto) to one or more hydraulic actuators on vehicle (10), one or more attachments mounted on vehicle (10) (e.g., an hydraulic auger or side bucket) and/or to one or more external hydraulic implements (e.g., a hand-held hydraulic rock breaker or hydraulic drill). These hydraulic fluid couplings are in fluid communication with the hydraulic system of vehicle (10). In this manner, the hydraulic fluid couplings are used to provide fluid communication between the hydraulic system of vehicle (10) and an actuator, attachment and/or implement connected to the couplings (e.g., via one or more hoses).

Figure 7:
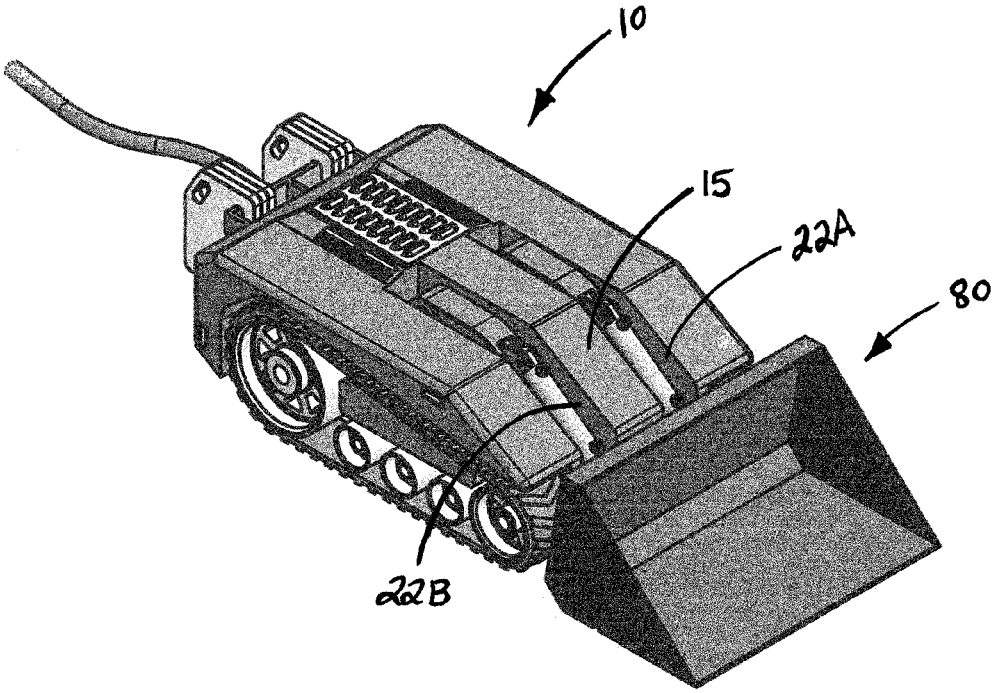
FIG. 7 is a perspective view of the cleaning vehicle of FIG. 1, wherein the plow blade and grinder assemblies have been replaced by a bucket assembly operatively attached to the cleaning vehicle.

The hydraulic fluid couplings may be provided at a variety of locations on vehicle (10), such as on center wall (15) at the front of body (14) (see FIG. 7). In some embodiments, one or more hydraulic fluid couplings may also be located in recessed areas of body (14) in order to, for example, prevent damage or dislodgement of the coupling and any hose or other fluid conduit attached thereto. By way of example, and as shown in FIGS. 18-32 for vehicle (1010), hydraulic couplings may be located on a wall of slots (1022A, 1022B).

Body (14) has a low profile so that vehicle (10) may travel into and operate within confined spaces, such as beneath a conveyor system (e.g. a conveyor belt). By way of example, when used beneath a conveyor belt such as that found in a coal mine, vehicle (10) may used to clear material from beneath the conveyor belt while the operator remains a safe distance away. Body (14) and other components of vehicle (10) are configured to allow vehicle (10) to be operated in such confined spaces, including the manipulation and operation of one or more attachments mounted to vehicle (10). Vehicle (10) includes a pair of hydraulically-movable support arms to which a variety of attachments may be mounted. Body (14) and the support arms are configured such that the support arms may be retracted into body (14), with little or no portion of the support arms extending above the upper surface of body (14) or the upper surface of a removable (or openable) cover located over drive unit (16), as further described herein.

In one embodiment, vehicle (10) is sized and configured so that the maximum height (also referred to as the clearance height) of vehicle (10), with the support arms retracted, is less than about 48 inches. As used herein, in embodiments wherein the support arms are retractable so as not to extend above the upper surface (18) of body (14) (see, e.g., FIG. 7), the clearance height of the vehicle refers to the distance from the ground to the upper surface (18) of body (14) of the assembled vehicle (10). In embodiments wherein the support arms are not retractable to below the upper surface of the vehicle, the maximum height of the vehicle refers to the distance from the ground to the upper surface of the support arms in their fully retracted position. In other embodiments, the clearance height may be less than about 40 inches, and in still other embodiments the clearance height may be about 34 inches. Of course vehicle (10) is not necessarily limited to any particular clearance height.

Figure 3:
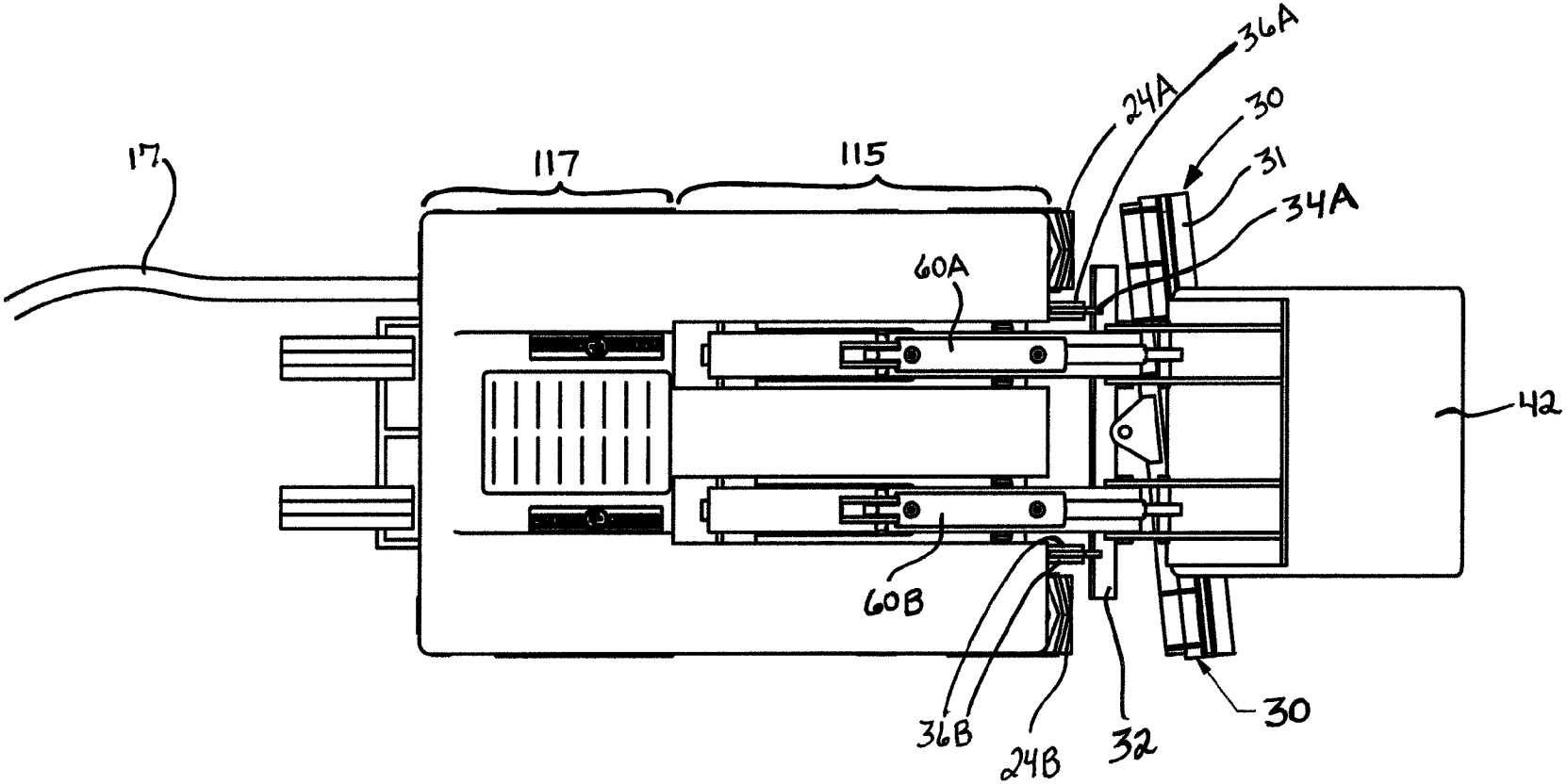
FIG. 3 is a top plan view of the cleaning vehicle of FIG. 1.

Vehicle (10) includes a pair of movable support arms (20A, 20B) which are at least partially received in slots (22A, 22B, respectively) which are located in a front portion (115) of body (14) (see FIG. 3). The control system, hydraulic system and components, and drive motors are located in the rear portion (117) of body (14) (see FIG. 3), distal to the distal ends of support arms (20A, 20B). By orienting the control, hydraulic and drive components in this manner, their weight can be used to offset the weight of any attachments mounted to the front (or proximal) ends of support arms (20A, 20B) and/or any attachment mounted to the front of the vehicle. In some embodiments, this may even eliminate the need to attach counterweights at the rear of the vehicle, further reducing the overall profile of the vehicle and simplifying operation and use.

Support arm receiving slots (22A, 22B) extend the entire length of the front portion (115) of body (14), and are open at the front end and along the top surface of body (14) (and optionally along at least a portion of the bottom surface of body (14)). As best seen in FIG. 7, center wall (15) of front portion (115) of body (14) extends between slots (22A, 22B). Slots (22A, 22B) are configured such that support arms (20A, 20B), and (optionally) even the hydraulic actuators attached thereto, may be retracted into slots (22A, 22B) so that little or no portion of the support arms (and optionally the attached actuators) extend above upper surface (18) of body (14) (see FIG. 7). When in the fully retracted position shown in FIGS. 7 and 8, proximal end portions (i.e., nearest the front of vehicle (10)) of the support arms (20A, 20B) extend outwardly away from the front end of body (14) such that one or more attachments may be mounted to the proximal ends of the support arms.

Depending on the type of attachment mounted to the proximal ends of the support arms (20A, 20B), the support arms (20A, 20B) may be fully received within slots (22A, 22B) when in their retracted position (see, e.g., FIG. 7). In other configurations, an attachment may prevent upper portions of support arms (20A, 20B) from being full retracted into the slots (22A, 22B), such that the support arms as well as the hydraulic actuators affixed to the upper surface of each support arm (20A, 20B) may extend above the upper surface (18) of body portion (14) (as shown in FIGS. 1 and 2). The degree of retractability of support arms (20A, 20B) depends, in part, on whether or not an attachment (further described herein) is pivotally affixed at the proximal ends of the support arms (20A, 20B), as well as the nature of the attachment.

In order to provide sufficient clearance and allow vehicle (10) to be used in confined spaces, support arms (20A, 20B), as well as the various attachments, may be configured such that, when the support arms (20A, 20B) are in their fully- or partially-retracted position (e.g., FIGS. 1 and 2), the height of the support arms (20A, 20*b*) and any structures affixed thereto is less than about 48 inches above the ground, or even less than about 40 inches or even 34 inches. Once again the scope of the present invention should not be limited to any particular clearance height, except as explicitly set forth in the claims.

Figure 16:
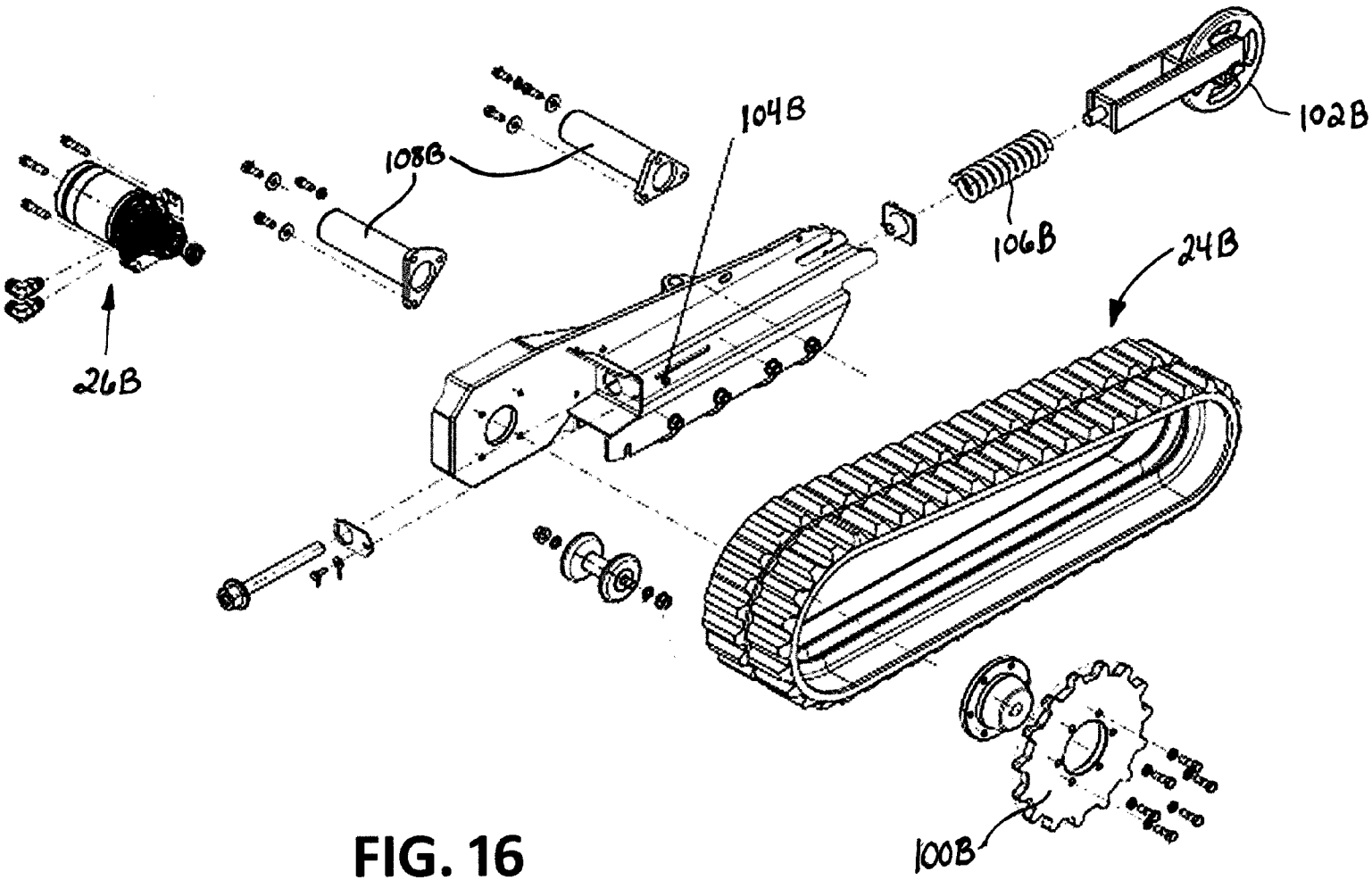
FIG. 16 is an exploded perspective view of the track drive mechanism of the cleaning vehicle of FIG. 1.

In the embodiment shown in FIGS. 1-16, vehicle (10) is moved by a pair of rotatable drive tracks (24A, 24B) provided on either side of vehicle (10). As shown in FIG. 16, each track (24A, 24B) is driven around a series of wheels by a hydraulic motor (26A, 26B). Motors (26A, 26B) are driven by selectively supplying pressurized hydraulic fluid thereto. Each motor (26A, 26B) may be separately and controllably driven so that the vehicle (10) may be driven forwards and backwards as well as turned (e.g., by driving one track forward and the other in reverse). Of course tracks (24A, 24B) may be replaced by, or used in combination with, one or more wheels—some of which may be driven and/or steered using suitable drive and steering arrangements.

Other components of the driving arrangement shown in FIG. 16 include drive sprocket (100B) which is rotatably driven by motor (26B) and idler wheel (102B). Drive track (24B) is driven by sprocket (100B) around idler wheel (102B). Idler wheel (102B) is slidably mounted to track tensioning slide (104B), and spring-biased by spring (106B). Tensioning slide (104B) is mounted to vehicle (10) by a pair of mounting pins (108B). Of course other drive track arrangements may be employed, and that depicted is merely exemplary of one contemplated embodiment.

Since vehicle (10) is configured such that a plurality of different attachments may be secured to the front end of vehicle (10), counterweights (28) may be attached to the rear of body portion (14) in order to balance the weight of vehicle (10). Counterweights (28) are configured to be hangably supported from hanger bar (29) located at the rear of body portion (14). Counterweights (28) may be added to, or taken off of hanger bar (29), as needed, in order to counterbalance the weight of attachments affixed to the front end of vehicle (10). In this manner, counterweights (28) will ensure that the vehicle (10) is properly balanced and will not, for example, tip over or tip up during use. In other embodiments, counterweights may not be required or may be optional depending on the weight of any attachments mounted on vehicle (10).

As mentioned previously, various attachments may be mounted to the front end of vehicle (10) for purposes of, for example, cutting or breaking material (e.g., coal) accumulated underneath or adjacent a conveyor belt, as well as for moving/pushing and/or collecting material from underneath or adjacent a conveyor belt. In some embodiments, multiple attachments may be mounted to the front end of vehicle (10) at the same time. In the example shown in FIGS. 1-6, an adjustable plow blade assembly (30) is mounted to the front of vehicle (10), and a grinder (or cutter) assembly (40) is pivotally mounted to the proximal ends of support arms (20A, 20B).

Figure 4:
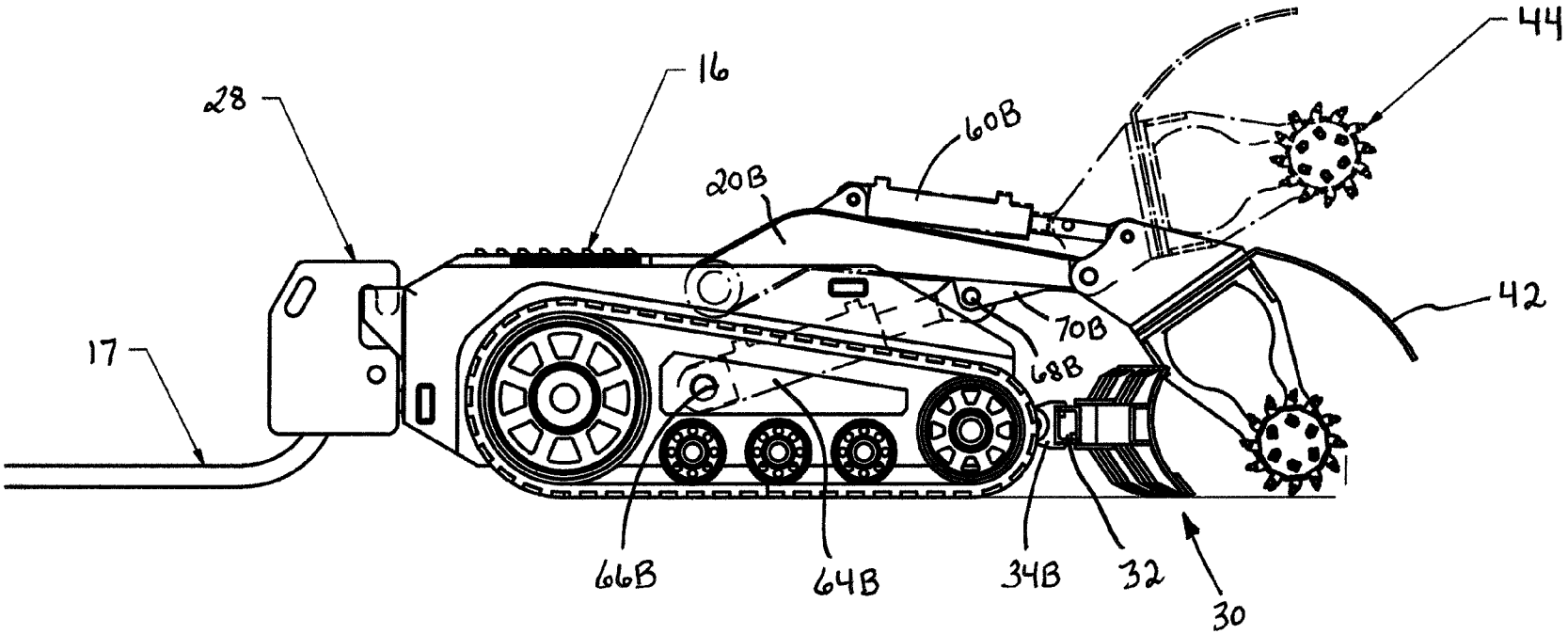
FIG. 4 is a side plan view of the cleaning vehicle of FIG. 1, which also depicts movement of the vehicle's support arms and pivoting of the attachment mounted thereto.
Figure 5:
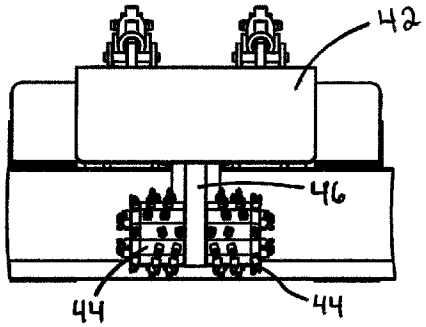
FIG. 5 is a front plan view of the cleaning vehicle of FIG. 1.
Figure 6:
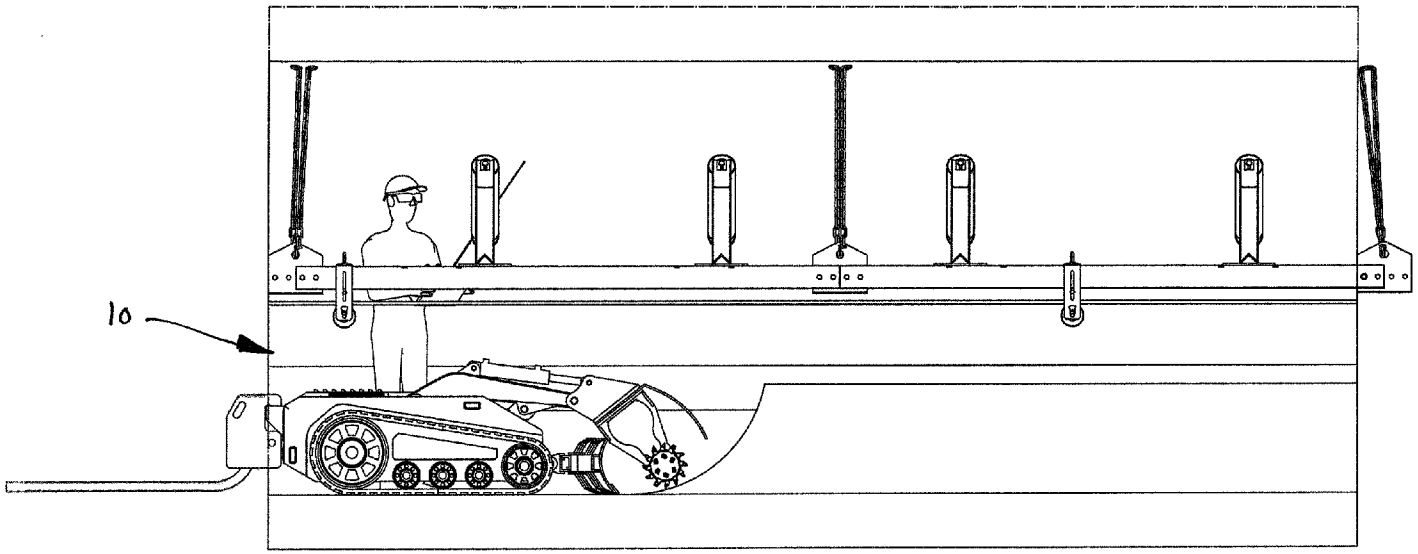
FIG. 6 is a side view depicting the use of the cleaning vehicle of FIG. 1 to clear material from beneath a conveyor belt in a coal mine, with the operator safely off to the side of the conveyor belt while controlling the operation of the cleaning vehicle.
Figure 17:
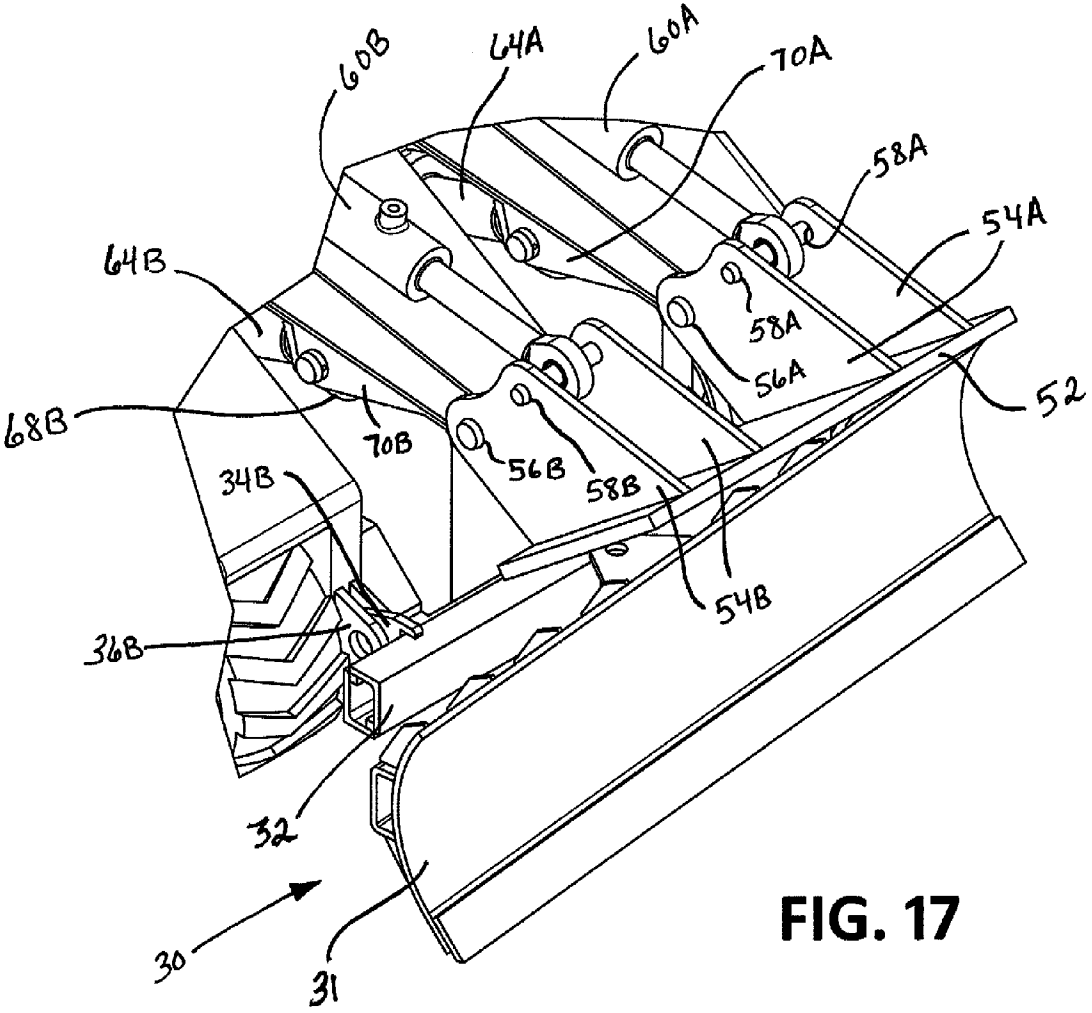
FIG. 17 is a perspective view of a portion of the front end of the vehicle of FIG. 1, wherein the grinder assembly (except for the mounting plate thereof) has been removed.

As best seen in FIGS. 3-4 and 17, plow blade assembly (30) includes a plow blade (31), a mounting bar (32) which extends across the rear of the plow blade (31), and a pair of mounting tabs (34A, 34B) which extend rearwardly away from mounting bar (32). The angle of plow blade (31) with respect to mounting bar (32) may be adjusted, as desired, so that the plow blade (31) will push debris and other material in the desired direction. A pair of spaced-apart mounting flanges (36A, 36B) are provided on the front end of vehicle (10), and are configured to receive mounting tabs (34A, 34B) therebetween. A pin or other type of fastener extends through apertures in mounting flanges (36A, 36B) and mounting tabs (34A, 34B) in order to retain plow assembly (30) on the front of vehicle (10). Plow assembly (30) may be removed from vehicle (10) prior to affixing other types of cleaning attachments (e.g., a bucket assembly) to the front of vehicle (10). Of course various other types of plow assemblies may be mounted to the front of vehicle (10), and vehicle (10) may be configured to accept any of a variety of plow assemblies for mounting thereto.

The embodiment shown in FIGS. 1-6 also includes a grinder (or cutting) assembly (40) pivotally attached to the proximal ends of support arms (20A, 20B). Grinder assembly (40) includes a curved deflector plate (42) which extends over a rotary cutting head (44) which is rotatingly supported from a central support housing (46) (see FIG. 5). As seen in the side and top views of FIGS. 14 and 15, cutting head (44) includes first and second portions (44A, 44B) located on either side of the proximal end of support housing (46). Cutting head (44) is rotatably driven by hydraulic motor (50) provided in central support housing (46), and includes a plurality of carbide cutter bits (48) arranged about the circumference of first and second portions (44A, 44B), as shown.

A pair of hydraulic hoses (49) supply pressurized hydraulic fluid to hydraulic motor (50), with one supply hose for driving motor (50) in one direction (e.g., clockwise) and the other supply hose for driving motor (50) in the opposite direction (e.g., counterclockwise). A return hydraulic hose (51) returns hydraulic fluid to the hydraulic fluid tank in vehicle (10). When pressurized hydraulic fluid is supplied to motor (50), cutting head (44) rotates such that cutter bits (48) may be used to break up rock, dirt, compacted coal, and various other materials. By way of one specific example, grinder assembly (40) is an AQ-1S Transverse Rock Cutter, available from the Antraquip Corporation, Hagerstown, Md. Of course other grinding/cutting heads and assemblies known to those skilled in the art can be used with vehicle (10) instead.

Grinder assembly (40) may be operatively attached to vehicle (10) such that cutting head (44) may be selectively and hydraulically driven for cutting, breaking, grinding, etc. material accumulated beneath or adjacent to a conveyor belt, or for various other purposes. Vehicle (10) may even be driven (i.e., moving) while such cutting is performed such that material broken-up or dislodged by cutting head (44) is pushed away by plow blade (31) at an angle to the direction of vehicle travel. Deflector plate (42) protects the conveyor belt and other structures above the rotating cutting head (44) during use of vehicle (10). It is also contemplated that a secondary safety plate may be attached or positioned beneath the conveyor belt or other overhanging structure during cleaning operations or other uses of vehicle (10).

Grinder assembly (40) also includes a mounting plate (52) having two pairs of spaced apart mounting flanges (54A, 54B) extending away from mounting plate (52), as shown in FIGS. 2 and 17. Each mounting flange (54A, 54B) includes lower apertures (56A, 56B) and upper apertures (58A, 58B). Lower apertures (56A, 56B) are used to pivotally attach mounting plate (52) to the proximal ends of support arms (20A, 20B) such that the proximal ends of each of the support arms are inserted between adjacent mounting flanges (54A, 54B), as shown. Pins or other fasteners may be used to pivotally retain mounting plate (52), and hence the grinder assembly (40), on the proximal ends of support arms (20A, 20B).

Each of support arms (20A, 20B) further includes an upper hydraulic actuator (60A, 60B) pivotally attached at its distal end to a mounting flange on the upper surface of the support arm. In the embodiment shown, the hydraulic actuators (60A, 60B) each comprise a hydraulic cylinder and piston (although other types of actuators may be used instead). The proximal end of each upper actuator (60A, 60B), specifically the proximal end of the actuator piston in the embodiment shown, is pivotally attached to grinder mounting plate (52), between adjacent mounting flanges (54A, 54B) at upper apertures (58A, 58B) (see FIGS. 2 and 17).

Hydraulic actuators (60A, 60B) are in fluid communication with the hydraulic fluid system of vehicle (10), such as via fluid hoses extending between ports on the actuators and suitable connectors provided on vehicle (10) (not shown). The hydraulic actuators (60A, 60B) may be selectively driven by selectively and controllably supplying pressurized hydraulic fluid thereto in order to cause grinder assembly (40) to pivot about lower apertures (56A, 56B) of mounting plate (52). For example, as actuators (60A, 60B) (i.e., the piston rods of the hydraulic cylinders) are extended, grinder assembly (40) pivots downwardly to the position shown in FIG. 6. When actuators (60A, 60B) are retracted, grinder assembly (40) pivots upwardly away from the ground as shown in dashed line in FIG. 4.

Vehicle (10) further includes a pair of lower hydraulic actuators (64A, 64B), each of which is pivotally mounted within one of slots (22A, 22B) of body (14) beneath one of support arms (20A, 20B). In the embodiment shown, lower actuators (64A, 64B) once again comprise hydraulic cylinders. The distal end (66A, 66B) of each lower actuator (64A, 64B) is pivotally secured within body portion (14) (see FIG. 4). The proximal end (68A, 68B) of each lower actuator (64A, 64B), specifically the proximal end of each piston thereof, is pivotally attached to a flange (70A, 70B) which is located on an undersurface of each support arm (20A, 20B) adjacent the proximal end of the support arm (see FIG. 4).

Lower actuators (64A, 64B) are used to selectively and pivotally raise and lower support arms (20A, 20B). Like upper hydraulic actuators (60A, 60B), lower actuators (64A, 64B) are in fluid communication with the hydraulic fluid system of vehicle (10), such as via fluid hoses extending between ports on the actuators and suitable connectors provided on vehicle (10) (not shown). The lower actuators (64A, 64B) may be selectively driven by selectively and controllably supplying pressurized hydraulic fluid thereto in order to cause the support arms to pivot about their distal ends. For example, as lower actuators (64A, 64B) are extended (e.g., the piston rods of hydraulic cylinders are extended), the proximal ends of support arms (20A, 20B) are pushed upwardly (see, e.g., FIG. 9). And when lower actuators (64A, 64B) are retracted, the support arms (20A, 20B) are returned to their retracted position (see, e.g., FIG. 7). Like upper actuators (60A, 60B), by controlling the pressurized fluid supplied to lower actuators (64A, 64B), support arms (20A, 20B) may be raised and lowered, as needed. In this manner, grinder assembly (40) can be pivoted to, and maintained at, any desired angle, and support arms (20A, 20B) can be raised or lowered to, and maintained at, any desired height.

Figure 8:
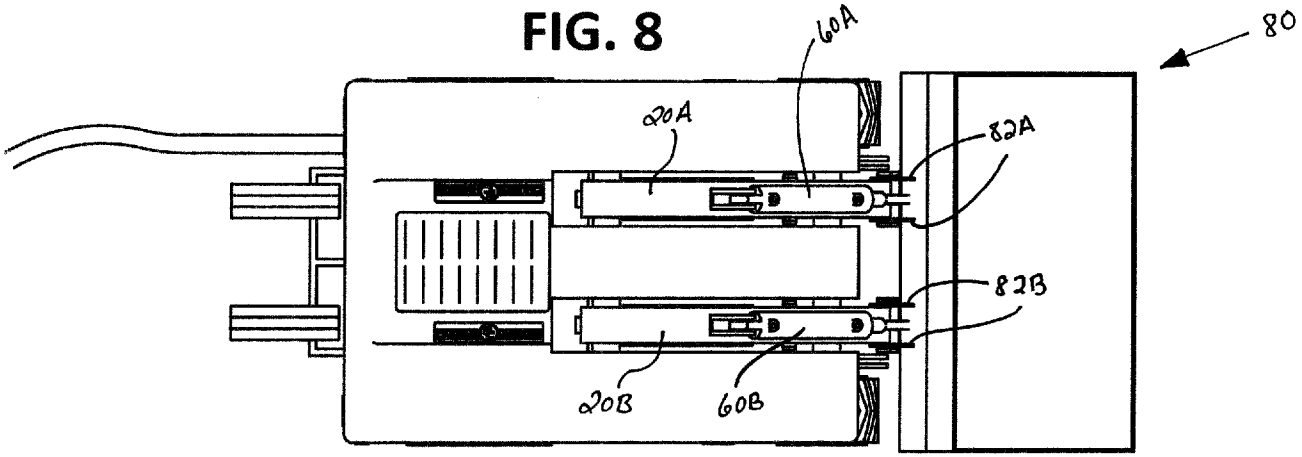
FIG. 8 is a top plan view of the cleaning vehicle of FIG. 7.
Figure 9:
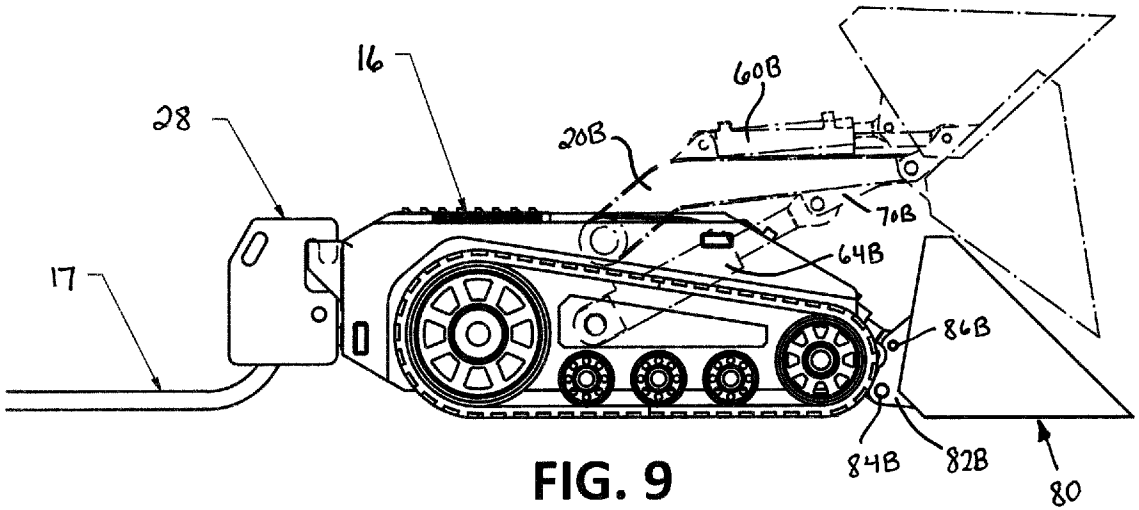
FIG. 9 is a side plan view of the cleaning vehicle of FIG. 7.
Figure 10:
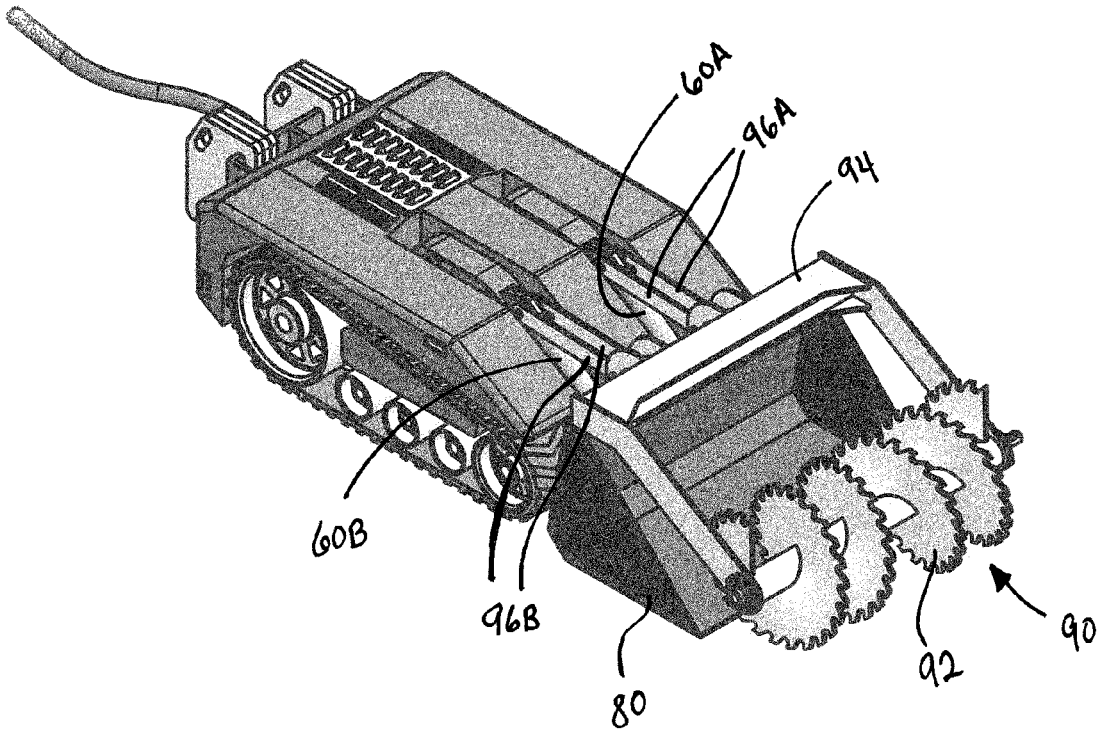
FIG. 10 is a perspective view of the cleaning vehicle of FIG. 7, wherein an auger assembly is operatively attached to the cleaning vehicle adjacent the bucket assembly.
Figure 11:
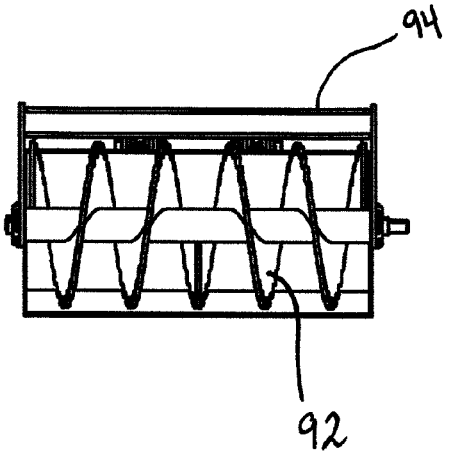
FIG. 11 is a front plan view of the cleaning vehicle of FIG. 10.
Figure 12:
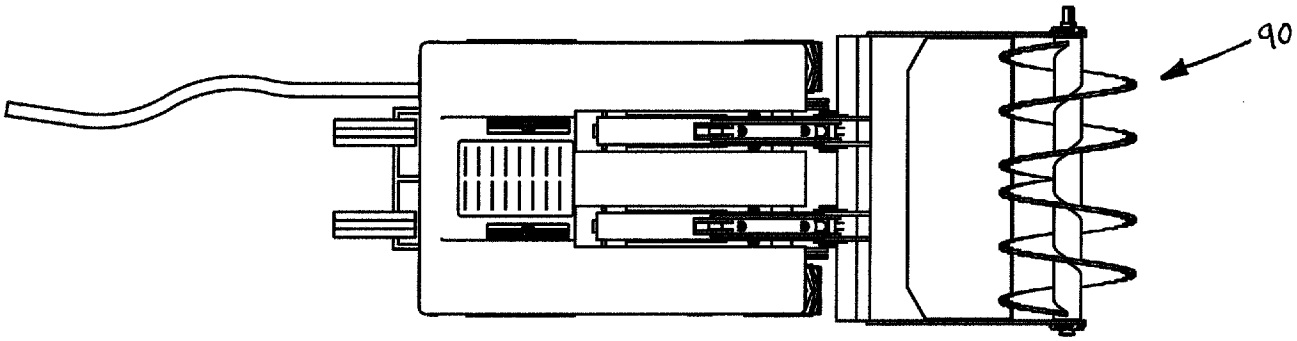
FIG. 12 is a top plan view of the cleaning vehicle of FIG. 10.

FIGS. 7-9 depict vehicle (10) wherein the plow and grinder assemblies have been removed, and a bucket assembly (80) is attached at the front of vehicle (10). Bucket assembly (80) may be used, for example, to move and lift debris and other material cleaned from beneath and/or adjacent a conveyor assembly. Thus, vehicle (10) is flexible in that any of a variety of attachments may be mounted thereto, such as those shown and described herein.

Like the grinder assembly, bucket assembly (80) also includes two pairs of spaced apart mounting flanges (82A, 82B) extending away from the rear face of the bucket, as shown in FIGS. 8 and 9. Each mounting flange (82A, 82B) includes lower apertures (84A, 84B) and upper apertures (86A, 86B). Lower apertures (84A, 84B) are used to pivotally attach the bucket to the proximal ends of support arms (20A, 20B) such that the proximal ends of the support arms are inserted between adjacent mounting flanges (82A, 82B), as shown. Pins or other fasteners may be used to pivotally retain the bucket on the proximal ends of support arms (20A, 20B).

The proximal end of each upper actuator (60A, 60B) is attached to bucket assembly (80), between adjacent mounting flanges (82A, 82B) at upper apertures (86A, 86B) (see FIG. 9). The upper actuators may be selectively driven to cause bucket assembly (80) to pivot about lower apertures (84A, 84B), as seen in FIG. 9. For example, as upper actuators (60A, 60B) are extended, bucket assembly (80) pivots downwardly. And when actuators (60A, 60B) are retracted, bucket assembly (80) pivots upwardly away from the ground.

Bucket assembly (80) may also be lifted away from the ground by selectively driving lower hydraulic actuators (64A, 64B) so as to cause support arms (20A, 20B) to be pivoted upwardly, as also seen in FIG. 9. Bucket assembly (80) may be used to move (i.e., push) debris and other material, as well to collect and lift material and thereafter deposit the material back onto the upper surface of the conveyor belt or some other location.

FIGS. 10-13 depict yet another arrangement in which a rotating auger assembly (90) is also mounted to vehicle (10), in front of bucket assembly (80). Auger assembly (90) includes a hydraulically-driven, rotating auger (92), attached to a mounting frame (94). Auger assembly (90) includes a hydraulic motor (not shown) and associated gear reduction (also not shown) whereby pressurized hydraulic fluid may be supplied to the motor in order to selectively and controllably rotate auger (92). Auger (92) may include cutting surfaces around its outer periphery to facilitate the cutting and breaking-up of material (e.g., compacted coal beneath a conveyor belt), with the rotating auger moving the material transverse to the direction of movement of the vehicle for collection in the bucket assembly (80) as the vehicle (10) is advanced in a forward direction.

Figure 13:
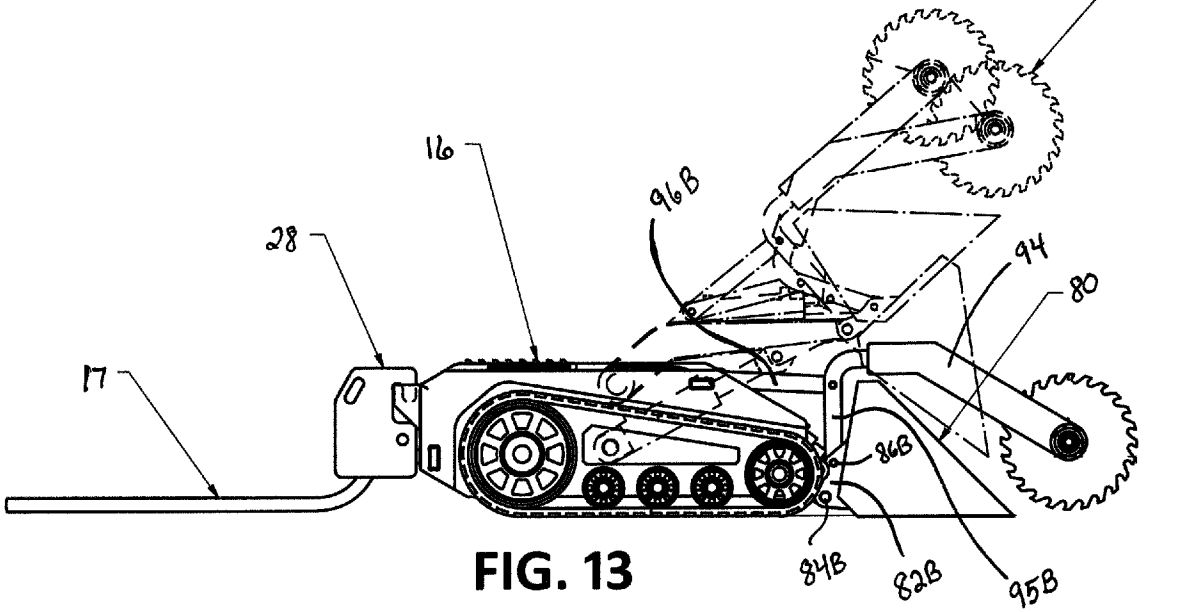
FIG. 13 is a side plan view of the cleaning vehicle of FIG. 10.
Figure 14:
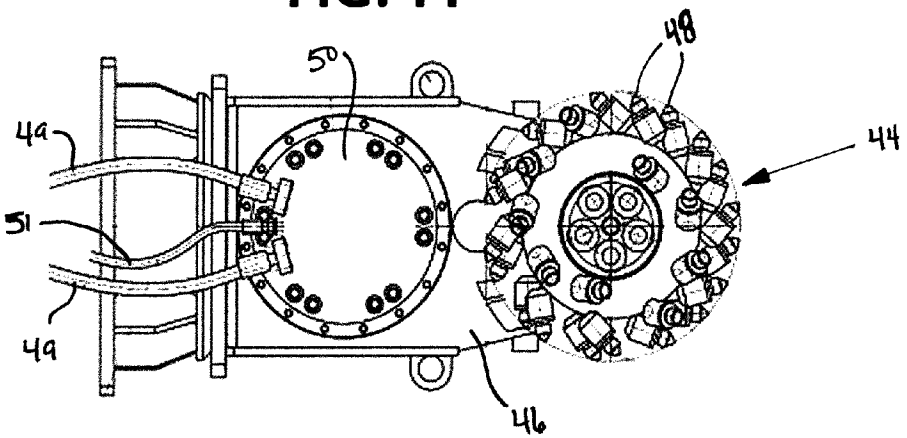
FIG. 14 is a schematic side view of a grinder assembly for use with the cleaning vehicle of FIG. 1.
Figure 15:
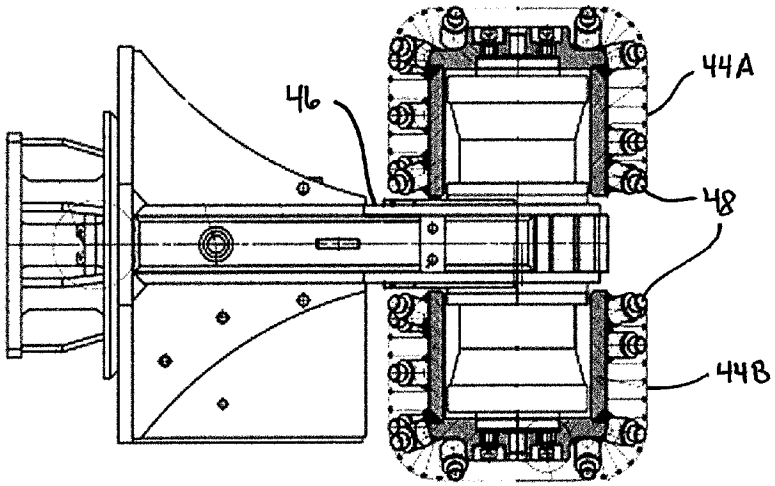
FIG. 15 is a schematic top, partial cross-sectional view of the grinder assembly of FIG. 14.

Mounting frame (94) of auger assembly (90) includes two pairs of first support arms (95A, 95B) extending downwardly and pivotally attached at the bottom thereof between adjacent mounting flanges (82A, 82B), at upper apertures (86A, 86B) of mounting flanges (82A, 82B), with the proximal ends of upper actuator (60A, 60B) between support arms (95A, 95B). Mounting frame (94) further includes two pairs of second support arms (96A, 96B) which extend rearwardly from respective ones of first support arms (95A, 95B). The distal ends of second support arms (96A, 96B) are pivotally attached to support arms (20A, 20B) at the distal ends of upper actuators (60A, 60B). In this manner, when support arms (20A, 20B) are raised to an elevated position (i.e., lower actuators (64A, 64B) extended), and upper actuators (60A, 60B) are extended so as to pivot bucket assembly (80) downwardly, auger (92) will not pivot downwardly (as depicted in FIG. 13). This allows for debris and collected material to be dumped from bucket (80) without interference from the auger (92).

FIGS. 18-32 depict an alternative embodiment of a cleaning vehicle (1010) as well as a cleaning vehicle system comprising vehicle (1010) and two or more attachments which may be mounted to and removed from vehicle (1010) by a user. As with the previous embodiment, more than one such removable attachment may be mounted to vehicle (1010) at the same time. In addition, one or more of the attachments may be mounted to vehicle (1010) such that the attachment may be manipulated by a user, such as through the use of remote control unit (12) previously described. The vehicle (1010) includes one or more mounting features which facilitate the mounting of the attachments to vehicle (1010), as further described below.

Figure 22:
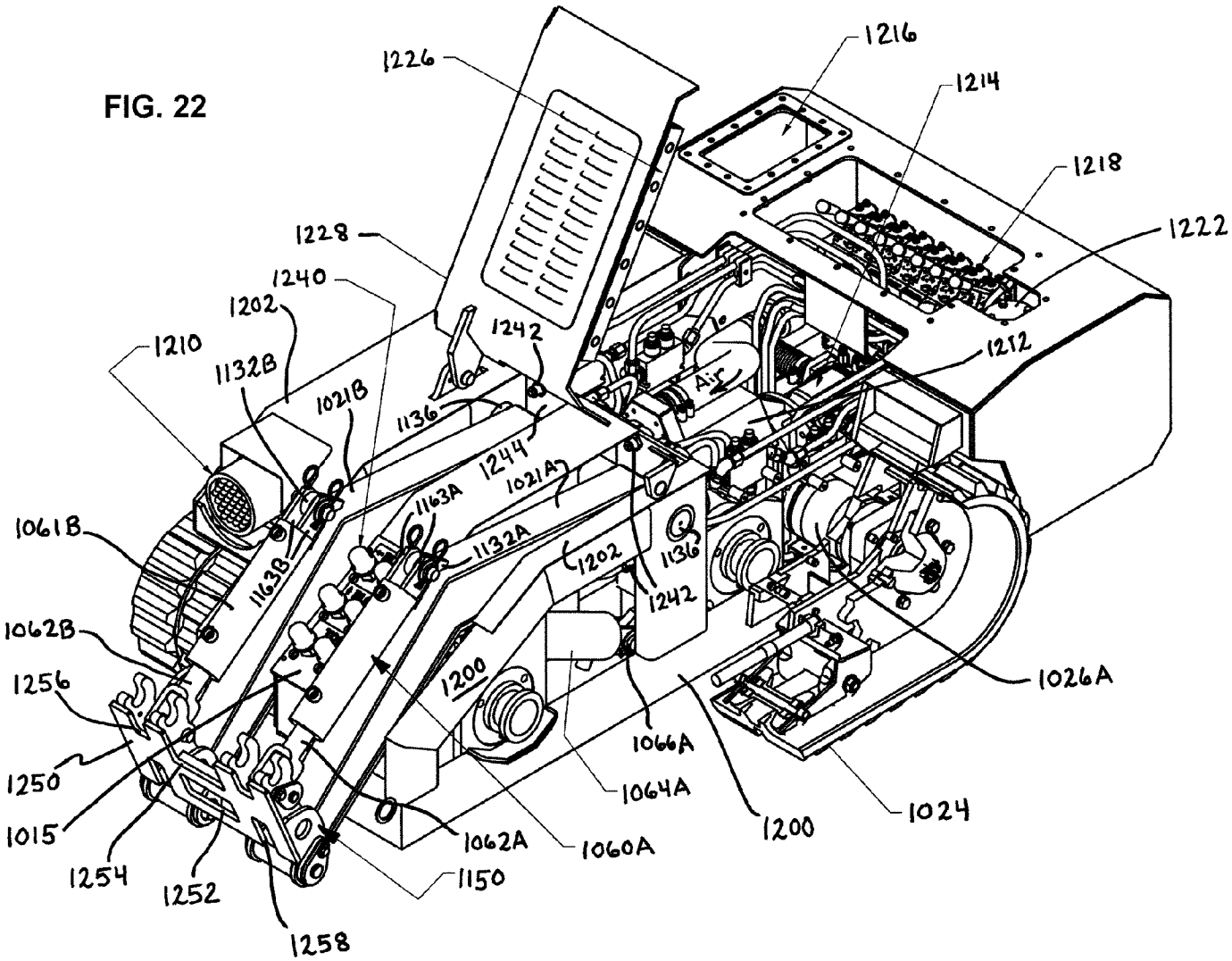
FIG. 22 is a perspective, partially cut-away view of the vehicle of FIG. 18, with the bucket removed.
Figure 23:
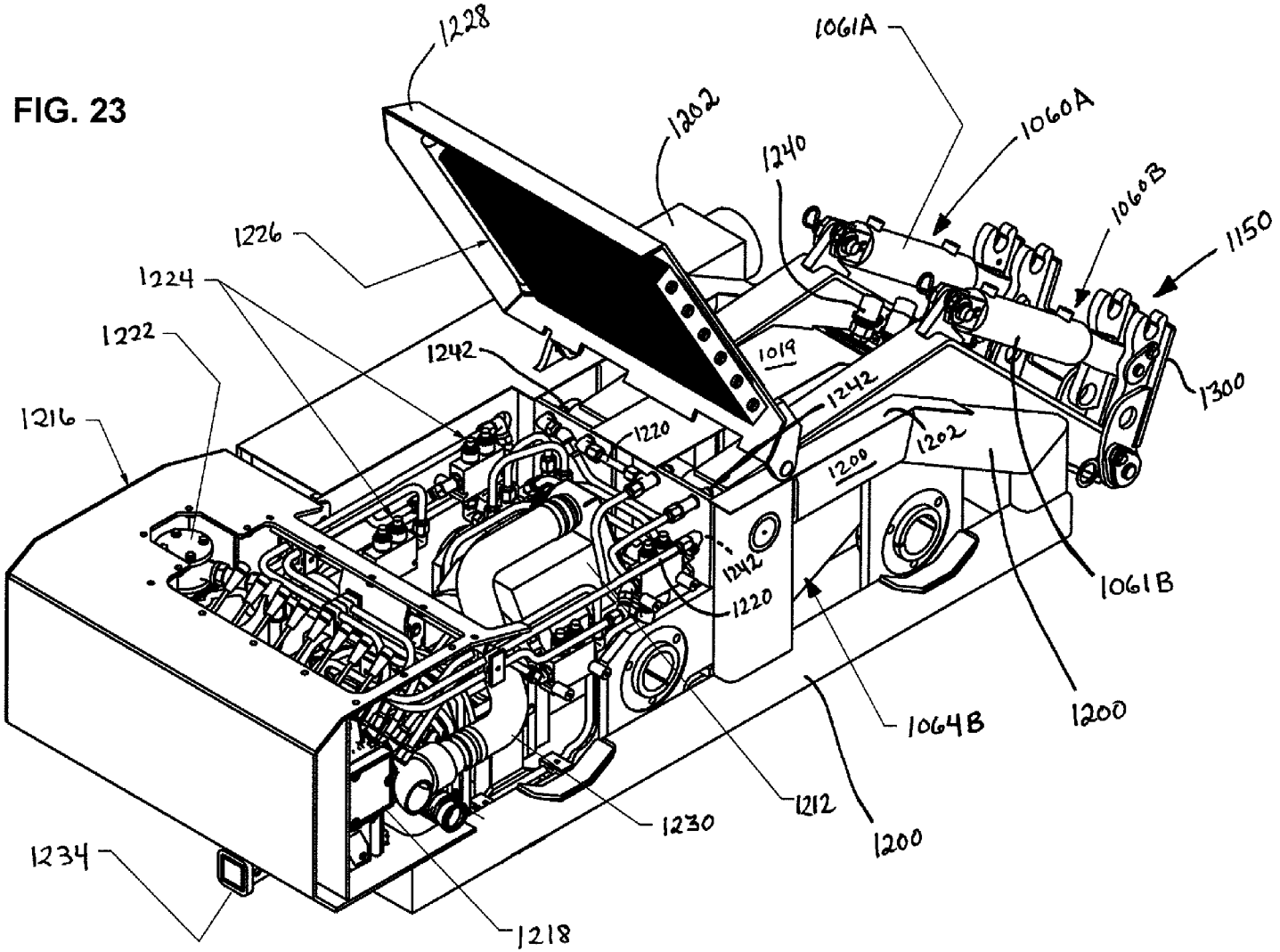
FIG. 23 is another perspective, partially cut-away view of the vehicle of FIG. 22.

Vehicle (1010) includes a body (1014) which may have any of a variety of shapes and configurations. In the embodiment shown, and as best seen in FIGS. 22 and 23, body portion (1014) generally comprises tubular frame elements (1200) welded together (i.e., a tubular frame of weldments) covered by a plurality of panels (1202) of heavy metal plate (e.g., steel plate) welded to and supported by the tubular frame elements (1200).

Figure 19:
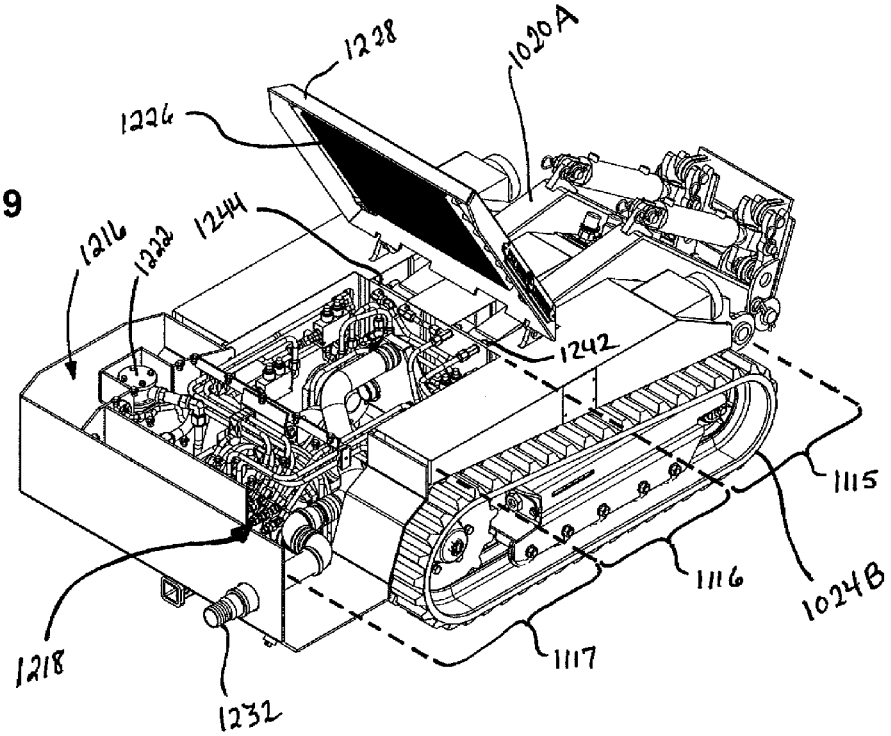
FIG. 19 is a perspective, partially cut-away view of the vehicle of FIG. 18, with the bucket and air motor removed.
Figure 20:
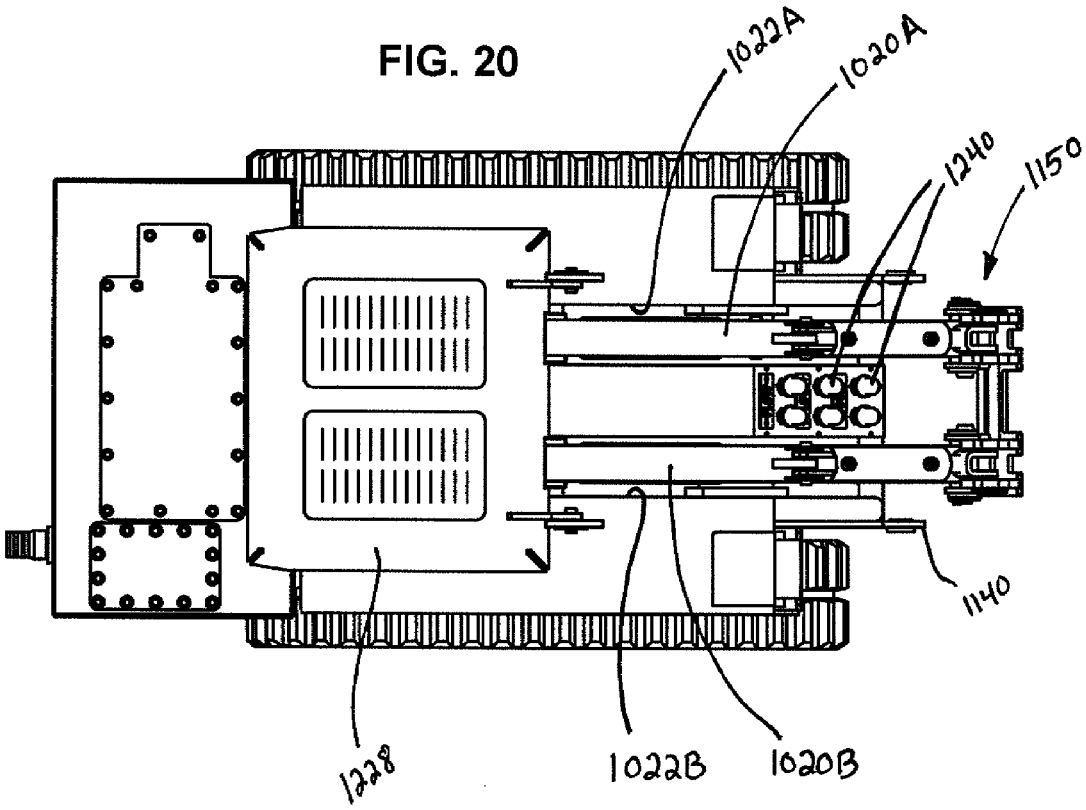
FIG. 20 is a top plan view of the vehicle of FIG. 19.

As further described herein body (1014) includes a front portion (1115) housing, among other things, support arms (1020A, 1020B), first rear portion (1116) housing, among other things, the air motor for driving one or more hydraulic pumps, and second rear portion (1117) in which much of the hydraulic componentry is located (see FIG. 19). Thus, except for the hydraulic actuators for lifting support arms (1020A, 1020B) and manipulating attachments mounted thereto, the hydraulic and control system components located within body (1014) are positioned distally (i.e., rearwardly) of support arms (1020A, 1020B) within rear portions (1116,1117).

Like the previously-described embodiment, vehicle (1010) is moved by a pair of rotatable tracks (1024A, 1024B) provided on either side of vehicle (1010). Separate hydraulic motors (1026A, 1026B) are provided for each track (1024A, 1024B), similar to the previously-described embodiment. Motors (1026A, 1026B) are driven by selectively supplying pressurized hydraulic fluid to each motor such that each of the motors (1026A, 1026B) may be separately and controllably driven in either direction in order to drive vehicle (1010) both forward and reverse, as well as turn vehicle (1010) in any desired direction. Once again tracks (1024A, 1024B) may be replaced by, or used in combination with, one or more wheels, some of which may be driven and/or steered using suitable drive and steering arrangements. Associated hardware for each track (1024A, 1024B) is similar to that shown in FIG. 16 and described above.

Body (1014) like the previously-described embodiment, has a low profile so that vehicle (1010) may travel into and operate within confined spaces, such as beneath a conveyor system. In fact, body (1014) may be sized and configured as described with respect to the previous embodiment.

Front portion (1115) of body (1014) includes a pair of pivoting support arms (1020A, 1020B) which are at least partially received in slots (1022A, 1022B), respectively. Slots (1022A, 1022B) extend the entire length of front portion (1115) and are open at the front (or proximal) end of vehicle (1010), as shown. Slots (1022A, 1022B) are also open at the upper surface of body (1014) in order to allow support arms (1020A, 1020B) to move pivotally upward out of slots (1022A, 1022B). Slots (1022A, 1022B) also may be open on the underside of body (1014). Alternatively, body (1014) may be fully enclosed along the bottom surface thereof, such as by providing one or more metal plates extending along the underside of body (1014) so as to cover and enclose the lower end of slots (1022A, 1022B).

Figure 18:
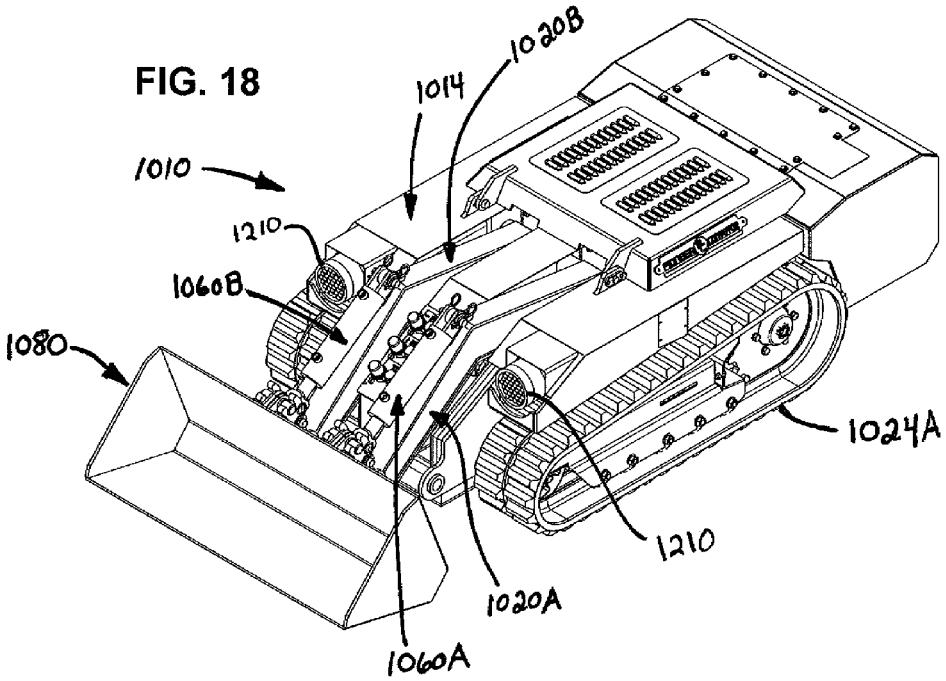
FIG. 18 is a perspective view of an alternative embodiment of a cleaning vehicle and an attached bucket.
Figure 21:
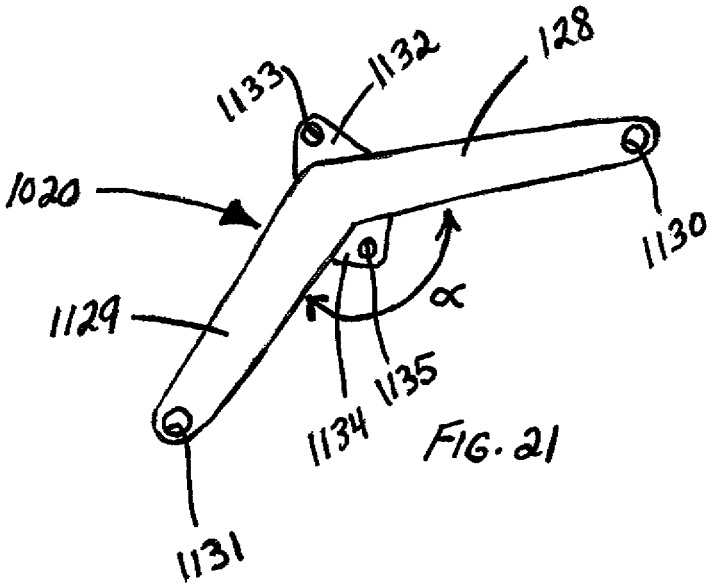
FIG. 21 is a side view of a support arm for the vehicle of FIG. 18.

As best seen in FIG. 21, each support arm (1020) generally comprises a proximal (or first) portion (1128) and a distal (or second) portion (1129). First and second portions (1128, 1129) extend away from each other at an included angle $\alpha$ of about 138 degrees. In other embodiments, angle $\alpha$ is between about 85 and about 180 degrees. And in still other embodiments, angle $\alpha$ is between about 120 and about 160 degrees. While support arm (1020) is similar to support arm (20) of the previous embodiment, second portion (1129) of support arm (1020) is relatively longer in order to provide additional clearance for certain types of attachments. In addition, as best seen in FIG. 18, the front portion (1115) of body (1014), specifically the portion located between tracks (1024), extends proximally beyond tracks (1024), providing greater clearance between attachments and tracks (1024).

Referring to FIG. 21, an aperture (1130) is provided at the proximal end of first portion (1128) of each support arm (1020), and a second aperture (1131) is provided at the distal end of second portion (1129) of each support arm (1020). While aperture (1130) on the proximal end of each support arm (1020) may be used for mounting an attachment thereto in the same manner as the previous embodiment, vehicle (1010) includes a coupler (1150) (see FIG. 22) for quickly mounting a variety of attachments to the front of vehicle (1010). Thus, as further described herein, aperture (1130) is used for pivotally attaching coupler (1150) to support arms (1020).

Aperture (1131) at the distal end of second portion (1129) of each support arm (1020) is used to pivotally attach the distal end of second portion (1129) of support arm (1020) to body (1014) of vehicle (1010). A support axle (1136) is secured within body (1014) at the distal end of first portion (1115) of body (1014) and extends through apertures (1131) at the distal ends of each support arm (1020) (see FIGS. 22 and 24). Support axle (1136) is fixed within body (1014), and extends across the width of slots (1022A, 1022B) just below the upper surface of body (1014) and above tracks (1024). Apertures (1131) are sized to allow the distal ends of support arms (1020) to rotate about support axle (1136), thereby allowing support arms (1020) to pivot upwardly and downwardly about support axle (1136). Alternatively, support axle (1136) may be rotatably secured within body (1014), with the distal ends of support arms (1020) affixed thereto, such that support axle (1136) will rotate in order to allow support arms (1020) to pivot upwardly and downwardly. Also, while the embodiment shown depicts a single support axle (1136) extending across the width of body (1014), it is also contemplated that separate, shorter support axles may be provided for each support arm (1020).

Each support arm (1020) further includes an upper actuator mounting tab (1132) having an aperture (1133) extending therethrough, and a lower actuator mounting tab (1134) having an aperture (1135) extending therethrough. In the embodiment shown, actuator mounting tabs (1132, 1134) are located adjacent the distal end of first portion (1128) and the proximal end of second portion (1129) of support arm (1020) (i.e., adjacent the intersection of first and second portions (1128, 1129)). As best seen in FIG. 22, each upper mounting tab (1132A, 1132B) is centrally located on the upper surface (1121A, 1121B) of its respective support arm (1020A, 1020B) (i.e., the mounting tab is equidistant from the inner and outer side edges of upper surface (1021)). Each lower mounting tab (1134) is similarly centrally located on the bottom surface of each support arm (1020).

Figure 24:
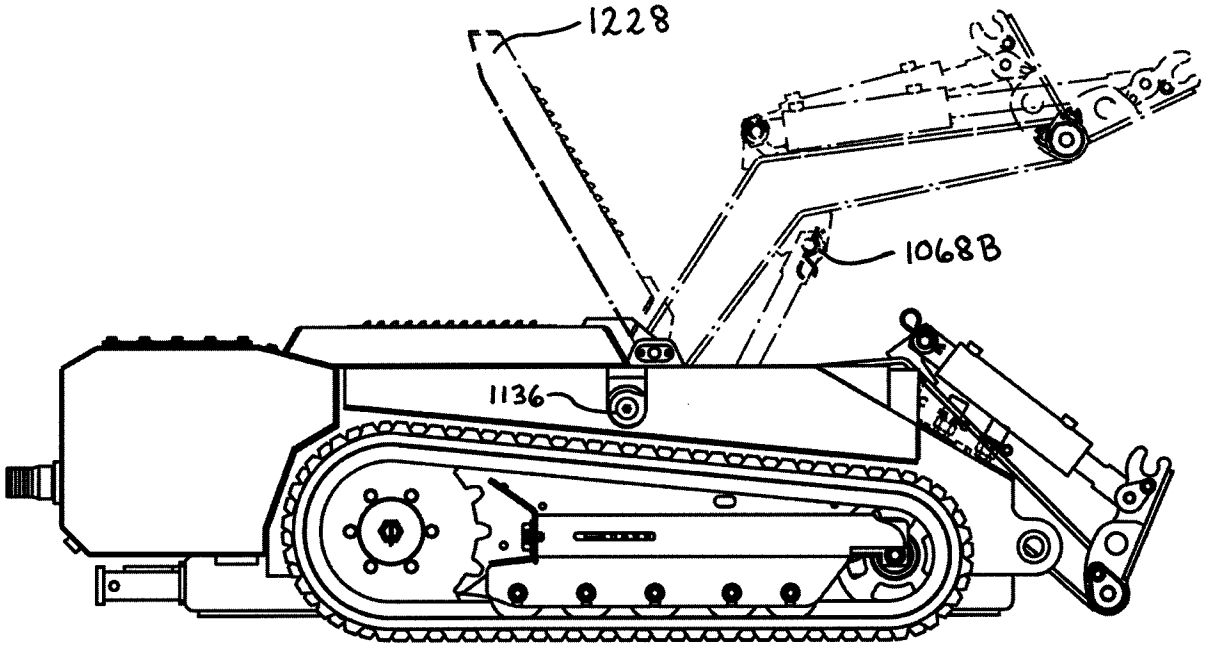
FIG. 24 is a side plan view of the vehicle of FIG. 23, depicting the movement of the support arms and tilting of the coupler.
Figure 25:
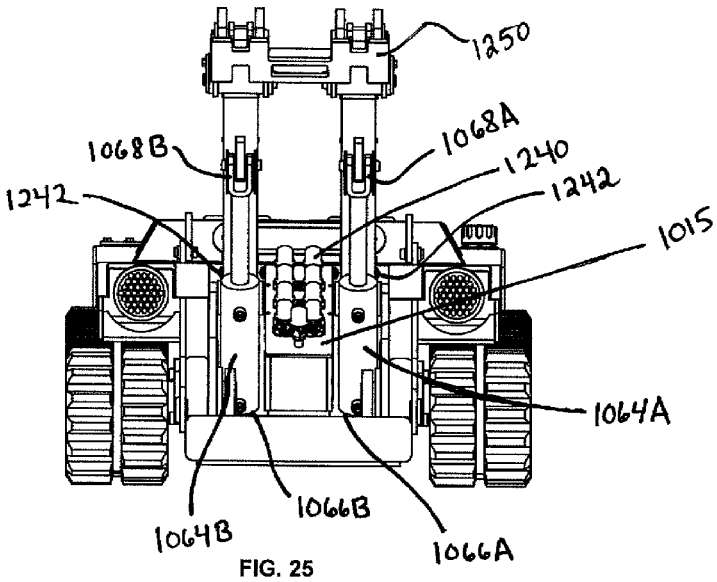
FIG. 25 is front view of the vehicle of FIG. 24.
Figure 26:
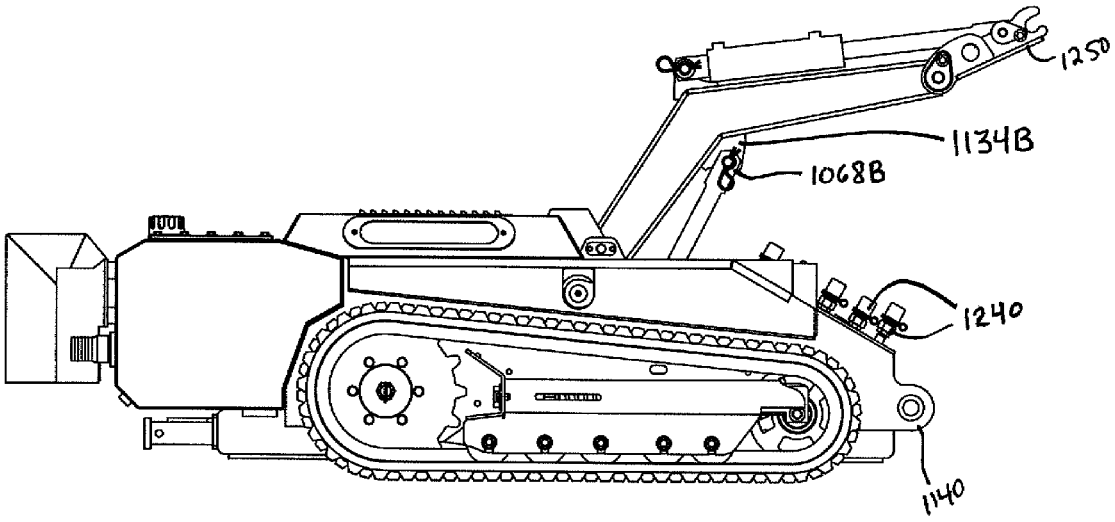
FIG. 26 is a side plan view of the vehicle of FIG. 23, wherein a battery box for housing one or more power supplies is attached to the rear of the vehicle.

As best seen in FIGS. 22-24, vehicle (1010), like vehicle (10), includes upper hydraulic actuators (1060A, 1060B) mounted to the upper surface of support arms (1020A, 1020B). Upper actuators (1060A, 1060B) each comprise a hydraulic cylinder (1061A, 1061B) and associated piston (1062A, 1062B) (see FIG. 23), although various other types of actuators may be used instead. The distal end of each upper actuator (1060A, 1060B) is pivotally attached to support arms (1020A, 1020B) at upper mounting tabs (1132A, 1132B). In particular, the distal end of each upper actuator (1060A, 1060B) includes a pair of spaced-apart, apertured flanges (1163A, 1163B), configured to receive an upper mounting tab (1132A, 1132B) therebetween. A hitch pin, held in place by cotter pins at opposite ends thereof, is inserted through the apertures of flanges (1163A, 1163B) and the aperture (1133) of upper mounting tab (1132A, 1132B) in order to pivotally attach the distal end of upper actuator (1060A, 1060B) to the upper surface of support arm (1020A, 1020B). Of course various other types of attachment members besides a hitch pin may be used.

The proximal end of upper actuator (1060A, 1060B), specifically the proximal end of piston (1062A, 1062B) is pivotally attached to coupler (1150), as further described below. As also described below, upper hydraulic actuators (1060A, 1060B) may be selectively driven to cause coupler (1150) to pivot about the proximal ends of support arms (1020A, 1020B). For example, as actuators (1060A, 1060B) (i.e., the piston rods of hydraulic cylinders) are extended, coupler (1150) pivots downwardly to the position shown in FIG. 26. When actuators (1060A, 1060B) are retracted, coupler (1150) pivots rearwardly as shown in FIG. 23.

Vehicle (1010) further includes a pair of lower hydraulic actuators (1064A, 1064B), each of which is pivotally mounted within one of slots (1022A, 1022B) of body (1014) beneath one of support arms (1020A, 1020B). By locating lower actuators (1064A, 1064B) directly beneath support arms (1020A, 1020B), vehicle (1010) can be made considerably more compact, with lower actuators (1064A, 1064B) compactly located in slots (1022A, 1022B). In the embodiment shown, lower actuators (1064A, 1064B) comprise hydraulic cylinders. The distal end (1066A, 1066B) of each lower actuator (1064A, 1064B) is pivotally secured within body portion (1014) (see FIGS. 22 and 25). The proximal end (1068A, 1068B) of each lower actuator (1064A, 1064B), specifically the proximal end of each piston thereof, is pivotally attached to flanges (1134A, 1134B) located on the underside of support arm (1020A, 1020B) (see FIGS. 25-26).

As in vehicle (10), lower actuators (1064A, 1064B) are used to pivotally raise and lower support arms (1020A, 1020B). For example, as lower actuators (1064A, 1064B) are extended (e.g., the piston rods of hydraulic cylinders are extended), the proximal ends of support arms (1020A, 1020B) are pushed upwardly (see, e.g., FIG. 24). And when lower actuators (1064A, 1064B) are retracted, the support arms (1020A, 1020B) are returned to their retracted position (see, e.g., FIG. 22).

Figure 28:
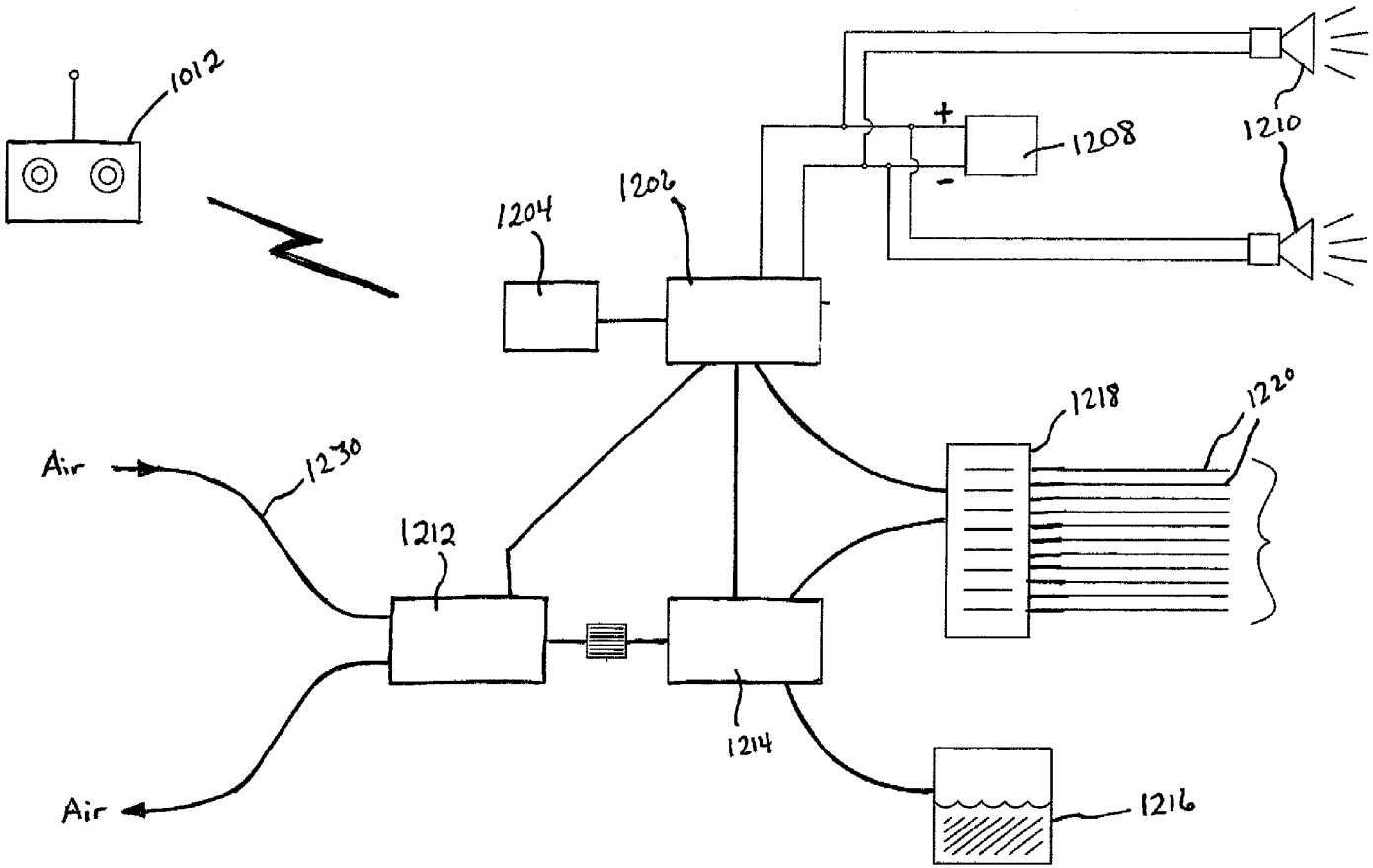
FIG. 28 is a schematic illustration of components of the control and hydraulic systems of the vehicle of FIG. 18.

FIG. 28 is a schematic illustration of the control system and hydraulic system of vehicle (1010). Remote control unit (1012) communicates wirelessly with receiver (or transceiver) (1204), which in turn passes control signals to micro-controller (1206). Micro-controller (1206) uses the received controlled signals in order to generate signals for controlling the various components of vehicle (1010). A power supply such as one or more batteries (1208) provides necessary power to micro-controller (1206) and optionally one or more of the additional components of vehicle (1010) such as LED head lamps (1210).

Air motor (1212) is powered by compressed air, under the control of micro-controller (1206). Air motor (1212) is coupled to a hydraulic piston pump (1214). Pump (1214) is in fluid communication with hydraulic fluid tank (1216) which is located in second rear portion (1117) of vehicle (1010) (see FIG. 19). Pump (1214), also under the control of micro-controller (1206), supplies pressurized hydraulic fluid to a set of hydraulic control valves (1218) also located in second rear portion (1117) of the vehicle. Under the control of micro-controller (1206), control valves (1218) selectively supply pressurized hydraulic fluid to hydraulic fluid conduits (1220), which may be placed in fluid communication with various hydraulically-actuated devices, such as actuators, drive motors (1026A, 1026B), and one or more attachments mounted to the vehicle. A suitable coupling may be provided at the terminus of each hydraulic fluid conduit (1220) such that a hydraulically-actuated device may be attached to the coupling in order to provide fluid communication and allow pressurized hydraulic fluid to be supplied thereto. Hydraulic fluid conducts (1220) may be provided in a variety of locations within vehicle (1010), as necessary.

Hydraulic fluid return lines (not shown in FIG. 28) are also provided, and return hydraulic fluid to tank (1216) through return filter (1222) (see FIG. 23). Hydraulic fluid holding valves (1224) (see FIG. 23) are also provided in order to maintain hydraulic fluid pressure within hydraulic actuators and the like. Any number of holding valves (1224) may be provided, as desired. As also seen in FIG. 23, an oil cooler (1226) is provided on the underside of cover (1228) which is hingedly attached to body (1014), as shown. Oil cooler (1226) is in fluid communication with the hydraulic fluid tank (1216) such that hydraulic fluid may be circulated through cooler (1226) for cooling purposes. An air supply line (1230) supplies compressed air to air motor (1212), and is in fluid communication with a compressed air coupling (1232) (see FIG. 19) located at the rear of the vehicle. As also seen in FIG. 23, a hitch receiver (1234) is provided at the rear of the vehicle to allow the attachment of various components or even other vehicles.

As mentioned previously, a plurality of hydraulic fluid couplings are provided on vehicle (1010), specifically on body (1014), at various locations. These couplings are used to not only supply hydraulic fluid to various actuators and attachments mounted to the vehicle, but also to return hydraulic fluid to hydraulic fluid tank (1216). In the embodiment shown, a first set of hydraulic fluid couplings (1240) are provided on a front center wall (1015) of body (1014) (see FIG. 22). Front center wall (or panel) (1015) is located between support arms (1020A, 1020B) and extends upwardly away from the front end of the vehicle between slots (1022A, 1022B). By locating the couplings (1240) at this location, the hydraulic fluid couplings (1240) are easily accessible, yet in a protected location so as to minimize potential damage to the couplings (1240) and/or prevent detachment of a hydraulic fluid hose or other conduit attached thereto.

A second set of hydraulic fluid couplings (1242) are provided within slots (1022A, 1022B), as best seen in FIGS. 22 and 23. Couplings (1242) are provided on the distal end wall (1244) of slots (1022A, 1022B) at a plurality of heights along the distal end wall (1244). In this manner, couplings (1242) are even further protected against damage and/or dislodgement of a hose or other conduit connected thereto. Second set of couplings (1242) are particularly suited for supplying and returning hydraulic fluid to and from actuators (1061A, 1061B, 1064A, 1064B). It will also be apparent that hydraulic fluid conduits (which may be rigid metal, flexible hose, or any other structure known to those skilled in the art), will extend through the center of first portion (1115) of body (1014), below top center wall (1019) (see FIG. 23), to the first (or front) set of hydraulic couplings (1240). Thus, these hydraulic fluid conduits will extend between slots (1022A, 1022B) of front portion (1115).

Figure 30:
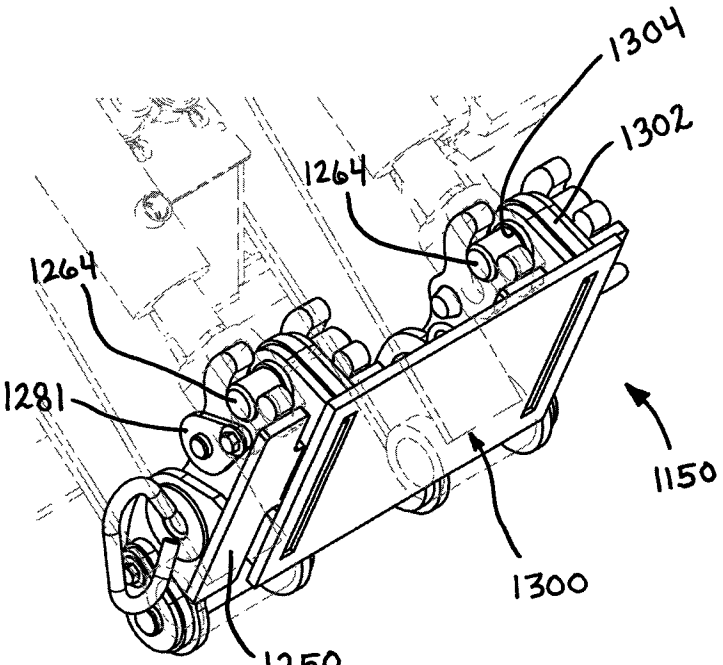
FIGS. 29 and 30 are perspective views of the coupler located at the front of the vehicle of FIG. 18, along with the mounting plate of a vehicle attachment.
Figure 29:
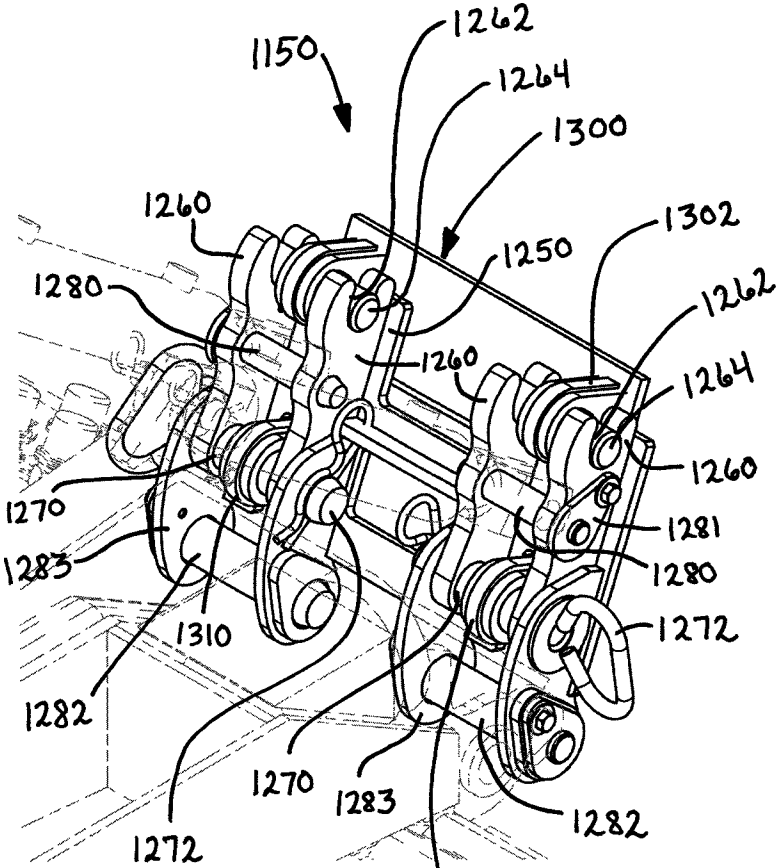

FIGS. 29 and 30 depict additional details of coupler (1150) along with a mounting plate (1300) configured for mating engagement with coupler (1150). Coupler (1150) generally includes a backing plate (1250), having a generally rectangular shape. As seen in FIG. 22, backing plate (1250) includes a central rectangular aperture (1252) as well as a central rectangular slot (1254) extending downwardly from the upper edge of backing plate (1250). Upper receiving slots (1256) also extend downwardly from the upper edge of plate (1250), on either side of central slot (1254). Lower receiving slots (1258) extend upwardly from the bottom edge of plate (1250), on either side of rectangular aperture (1252). As shown in FIGS. 29 and 30, receiving slots (1256, 1258) are configured to receive mounting flanges extending rearwardly away from mounting plate (1300).

Two pairs of elongate support members (1260) extend rearwardly away from backing plate (1250), as best seen in FIGS. 29 and 30. Arcuate grooves (1262) are provided at the upper end of each of the support members (1260) and are configured to receive mounting pins (1264) therein. A pair of upper mounting flanges (1302) extend rearwardly away from mounting plate (1300), each including an aperture (1304) extending through flange (1302). In this manner, in order to attach mounting plate (1300) to coupler (1150), upper flanges (1302) are inserted through upper receiving slots (1256) and pins (1264) (or similar structures) are inserted through apertures (1304), as shown. Pins (1264) are supported within arcuate grooves (1262). Alternatively, pins (1264) may be replaced by mounting pins which extend through apertures (1304) of flanges (1302) on plate (1300), and which are supportingly received within arcuate grooves (1262), in the same manner as shown.

Similarly, apertures (1270) are provided adjacent the lower end of each of the support members (1260). Mounting plate (1300) includes a second set of lower mounting flanges (1310) which may be inserted through lower receiving slots (1258) of backing plate (1250). Like the first set of flanges (1302), second flanges (1310) include a aperture extending therethrough, such that a mounting pin (1272) or similar structure may be inserted through apertures (1270) of support members (1260) and through the apertures in lower flanges (1310) in order to rotatingly retain second flanges (1310) between the lower ends of adjacent support members (1260).

Upper mounting pins (1280) are also provided on support members (1260) and extend between each pair of support members (1260), and are held in place by retention plates (1281) secured to the outermost support members (1260). Upper mounting pins (1280) are located between grooves (1262) and apertures (1270) on support members (1260). Upper mounting pins (1280) are used to attach coupler (1150) to the proximal ends of upper actuators (1060A, 1060B), as best seen in FIG. 23.

Lower mounting pins (1282) are also provided on coupler (1150), and are rotatingly supported beneath each pair of support members (1260) by two pairs of lower attachment plates (1283). Lower attachment plates (1283) are retained below support members (1260) by mounting pins (1272), as shown in FIGS. 29 and 30. Lower mounting pins (1282) are used to attach coupler (1150) to the proximal ends of support arms (1020A, 1020B), as also seen in FIG. 23, and allow coupler (1150) to pivotally rotate with respect to the support arms (1020A, 1020B), about the axis of lower mounting pins (1282).

Figure 27:
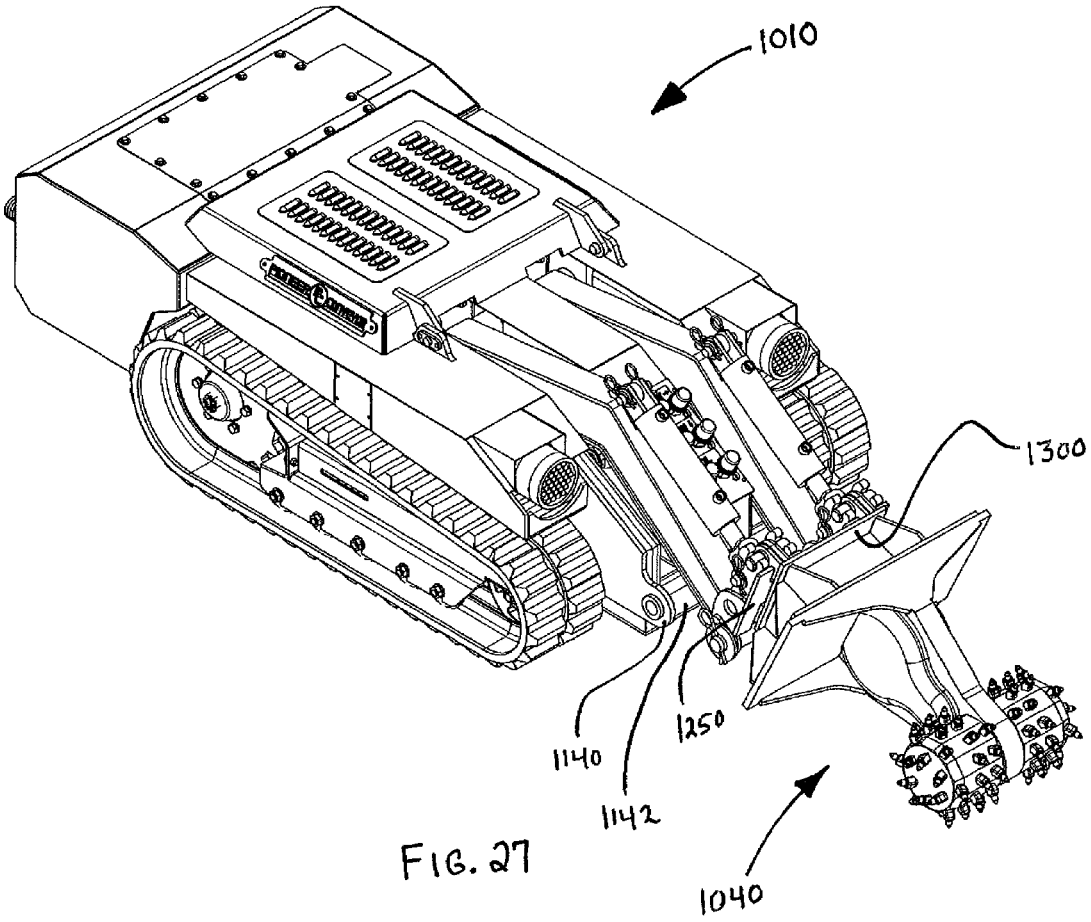
FIG. 27 is a perspective view of the vehicle of FIG. 18, wherein the bucket has been replaced by a grinder assembly.

Coupler (1150) provides a variety of advantages, including the ability to utilize a standardized mounting plate (1300) for mounting a variety of attachments to the vehicle. For example, as shown in FIG. 27, a grinder assembly (1040) having mounting plate (1300) attached thereto can be easily mounted to coupler (1150) of the vehicle. As also seen in FIG. 27, apertured mounting tabs (1140) extend away from the lower front end of body (1014) beneath support arms (1020A, 1020B). Mounting tabs (1140) may be used to attach a variety of structures to the vehicle such as a plow or other implement. In the example shown, a mounting bar (1142) extends between tabs (1140) and may be further used to attach, for example, a plow to the front of the vehicle (or any of a variety of other implements) similar to the way in which plow (30) is attached to vehicle (10) in FIG. 1.

Figure 31:
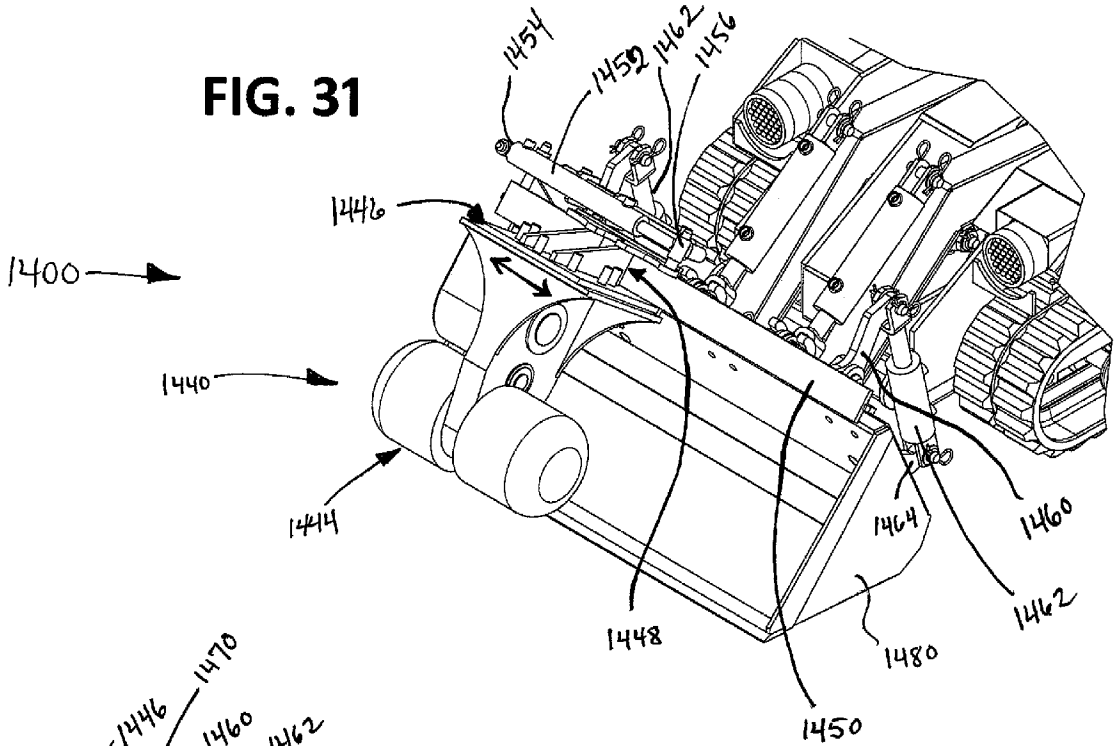
FIG. 31 is perspective view of the front portion of the vehicle of FIG. 18, wherein the bucket has been replaced by a combined grinder/bucket assembly.
Figure 32:
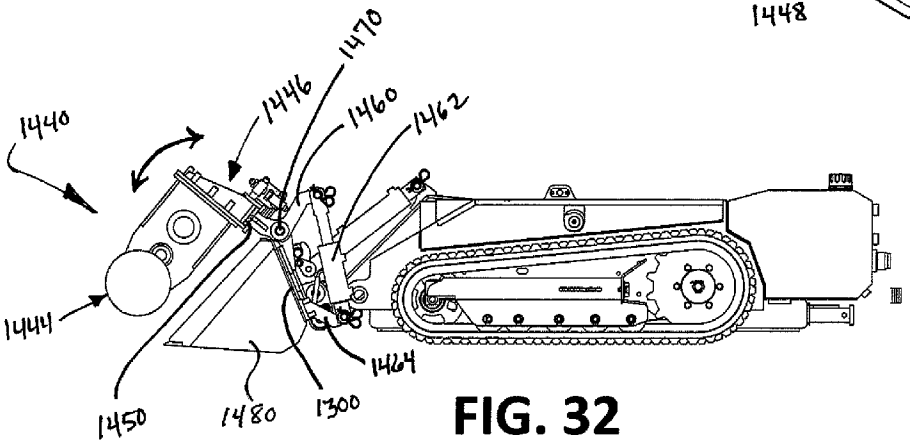
FIG. 32 is a side plan view of the vehicle of FIG. 31.

FIGS. 31 and 32 depict yet another attachment which may be mounted to vehicle (1010). In this embodiment, attachment (1400) comprises a combined grinder and bucket assembly configured such that the bucket (1480) may be raised/lowered and tilted (similar to that shown in FIG. 13) and grinder assembly (1440) may be independently tilted up/down and moved transversely along the length of bucket (1480).

Bucket (1480) includes mounting plate (1300) along its rear surface. Mounting plate (1300) allows bucket (1480) to be mounted to coupler (1150) of the vehicle in the manner described previously, such that bucket (1480) may be raised and lowered by support arms (1020A, 1020B), and tilted downwardly and upwardly by upper actuators (1060A, 1060B). As upper actuators (1060A, 1060B) extend or retract, coupler (1150) and hence mounting plate (1300) rotatingly pivot about the axis of lower mounting pins (1282) of coupler (1150).

Grinder assembly (1440) includes cutting head (1444) (wherein the cutting teeth have been omitted in FIGS. 31 and 32) similar to cutting head (44) described previously. A slide carriage (1446) is provided at the distal end of grinder assembly (1440). Slide carriage (1446) includes a receiving slot (1448) configured to slidingly receive a slide bar (1450) which extends across the width of the upper edge of bucket (1480). Grinder assembly (1440) may be moved transversely across the width of bucket (1480) by sliding along slide bar (1450).

In order to effect transverse movement of grinder assembly (1440) with respect to bucket (1480), slide actuator (1452) is provided and extends parallel to the width of bucket (1480) and slide bar (1450). One end (1454) of slide actuator (1452) is fixed in relation to slide bar (1450) while the other end (1456) is secured to slide carriage (1446). Thus, by hydraulically driving slide actuator (1452), carriage (1446) and grinder assembly may be moved back and forth along slide bar (1450). In this manner, a user may employ the remote control unit to effect transverse movement of grinder assembly (1440) with respect to bucket (1480) during use. This allows the vehicle to be grind/cut more material without having to move vehicle (1010).

Slide bar (1450) may be fixedly attached to along the upper edge of bucket (1480). In the embodiment shown, however, slide bar (1450) is pivotally supported along the upper edge of bucket (1480) by a pair of pivot arms (1460) which are pivotally supported by mounting plate (1300). Pivot arms (1460) are generally L-shaped, with a first end attached to the rear face of slide bar (1450), and a second end attached to one end of tilt actuators (1462). In the embodiment shown, the upper piston end of each tilt actuator (1462) is attached to the second end of one of pivot arms (1460) and the lower cylinder end of each tilt actuator (1462) is secured to support legs (1464) which extend from the rear of mounting plate (1300). Pivot arms (1460) thus pivotally support slide bar (1450). When tilt actuators (1462) are retracted, the second end of pivot arms (1460) are pulled downwardly, causing slide bar (1450) as well as grinder assembly (1440) to rotate upwardly away from bucker (1480). Conversely, when actuators (1462) are extended, grinder assembly (1440) will tilt (i.e., rotate) downwardly about the center axis (1470) of pivot arms (1460). Once again a user may employ the remote control unit to effect pivotal movement of grinder assembly (1440) with respect to bucket (1480) during use. Similarly, the user may remotely cause the bucket (1480) to raise, lower and tilt up and down, using the remote control unit, as well drive the vehicle itself.

It will be understood that the manner in which the grinder assembly is mounted to, and is transversely and rotatingly moveable with respect to the bucket may be accomplished in a variety of alternative ways. The embodiment shown in FIGS. 31 and 32 is merely exemplary of one embodiment.

The vehicles described herein may be used for any of a variety of purposes, such as cleaning coal debris and the like in a coal mine (e.g., beneath conveyor belts). Using the embodiment shown in FIGS. 31 and 32, the user may remotely advance the vehicle to the location where cleaning is desired, actuate the cutting head (1444) to being grinding material to dislodge the material which also moving the cutting head (1444) back and forth across the front of the bucket, drive the vehicle forward to cause the bucket (1480) to capture the dislodged material therein, raise the bucket full of dislodged material and then deposit the dislodged material to a desired location by tilting bucket (1480) downwardly (e.g., back onto a conveyor belt, into a container, etc.).

While several devices and components thereof have been discussed in detail above, it should be understood that the components, features, configurations, and methods of using the devices discussed are not limited to the contexts provided above. In particular, components, features, configurations, and methods of use described in the context of one of the devices may be incorporated into any of the other devices. Furthermore, not limited to the further description provided below, additional and alternative suitable components, features, configurations, and methods of using the devices, as well as various ways in which the teachings herein may be combined and interchanged, will be apparent to those of ordinary skill in the art in view of the teachings herein.

Versions of the devices described above may be actuated mechanically or electromechanically (e.g., using one or more electrical motors, solenoids, etc.). However, other actuation modes may be suitable as well including but not limited to pneumatic and/or hydraulic actuation, etc. Various suitable ways in which such alternative forms of actuation may be provided in a device as described above will be apparent to those of ordinary skill in the art in view of the teachings herein.

Having shown and described various versions in the present disclosure, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, versions, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

What is claimed is:

1. A remotely-operable vehicle for cleaning material from beneath a structure, comprising:

(a) body having a front portion and a rear portion;

(b) a pair of support arms, each support arm pivotally supported at its distal end within the body;

(c) a drive system for moving the vehicle having at least one drive motor;

(d) a hydraulic system having a hydraulic fluid tank, a hydraulic fluid pump, and a plurality of hydraulic fluid couplings for supplying hydraulic fluid to conduits attached thereto;

(e) a receiver for receiving control signals from a remote control device;

(f) a processor which generates signals for operating the drive system and the hydraulic system in response to received control signals; and (d) at least one cleaning attachment, removably attached to the vehicle at a proximal end of each support arm, wherein said at least one cleaning attachment is configured to be manipulated remotely by a user using a remote control device;

wherein the front portion of the body includes a pair of support arm receiving slots, each of said slots extending rearwardly from the front end of the body, wherein each support arm is pivotally supported at its distal end within one of said slots and is at least partially retractable into said slots, and further wherein said front portion of the body includes a front center wall that extends upwardly away from a front end of the vehicle between said slots and said support arms, with at least a portion of said hydraulic fluid couplings located on said front center wall of the body.

2. The vehicle of claim 1, wherein the vehicle includes a pair of cleaning attachments removably attached to the vehicle, one attachment comprising a grinder assembly removably attached to the vehicle at a proximal end of each support arm, and the other attachment comprising a plow blade removably attached to the front of the vehicle below said grinder assembly, wherein at least one of said cleaning attachments is configured to be manipulated remotely by a user.

3. The vehicle of claim 1, wherein the vehicle includes a pair of cleaning attachments removably attached to the vehicle, one attachment comprising a grinder assembly removably attached to the vehicle at a proximal end of each support arm, and the other attachment comprising a bucket assembly removably attached to the vehicle at a proximal end of each support arm, wherein at least one of said cleaning attachments is configured to be manipulated remotely by a user.

4. The vehicle of claim 1, wherein the vehicle includes a pair of cleaning attachments removably attached to the vehicle, one attachment comprising an auger assembly removably attached to the vehicle at a proximal end of each support arm, and the other attachment comprising a bucket assembly removably attached to the vehicle at a proximal end of each support arm, wherein at least one of said cleaning attachments is configured to be manipulated remotely by a user.

5. The vehicle of claim 1, further comprising a pair of hydraulic actuators associated with each of the support arms, each pair including upper and lower actuators, wherein the upper actuators are configured for effecting pivotal movement of a cleaning attachment affixed to proximal ends of the support arms, and the lower actuators are configured for raising and lowering the support arms.

6. The vehicle of claim 5, wherein said cleaning attachment comprises a combined grinder assembly and bucket removably attached to the vehicle at a proximal end of each support arm, wherein the grinder assembly and bucket are each configured to be independently manipulated remotely by a user.

7. The vehicle of claim 6, wherein the grinder assembly is attached to the vehicle above and in front of said bucket, said grinder assembly configured to be transversely movable across at least a portion of the width of the bucket and pivotally movable away from the bucket, wherein both the transverse and pivotal movement of the grinder assembly result from signals generated by the processor in response to received control signals.

8. The vehicle of claim 7, wherein the cleaning attachment further comprises at least two additional hydraulic actuators, one for effecting said transverse movement of the grinder assembly and one for effecting said pivotal movement of the grinder assembly.

9. The vehicle of claim 1, further comprising a plurality of hydraulic fluid couplings for supplying hydraulic fluid to conduits attached thereto, at least one hydraulic fluid coupling located within one of said slots, and at least one hydraulic fluid coupling located on an outer surface of the body between said slots.

10. The vehicle of claim 1, further comprising an air-powered pneumatic motor for driving said hydraulic fluid pump.

11. The remotely-operable vehicle of claim 5, wherein each of said slots extends rearwardly from the front end of the body to a distal end wall of the front portion of the body, said drive system further includes a pair of separately drivable drive tracks operatively mounted to said body, each having an associated drive motor, and said hydraulic system further includes a plurality of control valves, wherein said hydraulic fluid pump is in fluid communication with the tank and control valves, and supplies pressurized hydraulic fluid from the tank to said control vales for distribution to said drive motors and said actuators, further comprising a remote control device configured to allow a user to transmit control signals from the remote control device to the vehicle for controllably driving the vehicle as well as controllably manipulating said at least one cleaning attachment.

12. The vehicle of claim 11, wherein said drive motors, hydraulic fluid tank, hydraulic fluid pump, and plurality of control valves of the vehicle are located in the rear portion of the body, distal to said slots and support arms.

13. The vehicle of claim 12, wherein said vehicle further comprises a coupler pivotally attached to the proximal end of each support arm, said coupler configured for attachment of said at least one cleaning attachment at the proximal ends of the support arms.

14. The vehicle of claim 12, wherein the distal end of each of said lower actuators is pivotally supported at a lower distal end of said slots.

15. The vehicle of claim 13, wherein said cleaning attachment comprises a grinder assembly and bucket, wherein the grinder assembly is attached to the vehicle above and in front of said bucket, said grinder assembly configured to be transversely movable across at least a portion of the width of the bucket and pivotally movable away from the bucket, wherein both the transverse and pivotal movement of the grinder assembly result from signals generated by the processor in response to control signals received from said remote control device.

16. The vehicle of claim 11, wherein said vehicle further comprises an air coupling configured for operative engagement with a source of compressed air, and a pneumatic motor in communication with said air coupling for driving said hydraulic fluid pump using compressed air.

17. A method of cleaning coal from beneath a conveyor belt in a coal mine, comprising the steps of:

(a) remotely driving a remotely-operable vehicle beneath a conveyor belt having coal therebeneath, said vehicle having a body having a front portion and a rear portion, at least one support arm pivotally supported at its distal end by the body, a drive system for moving the vehicle having at least one drive motor, a hydraulic system having a hydraulic fluid tank and a hydraulic fluid pump, a receiver for receiving control signals from a remote control device, a processor which generates signals for operating the drive system and the hydraulic system in response to received control signals, and a pair of cleaning attachments removably attached to the vehicle at a proximal end the at least one support arm and configured to be manipulated remotely by a user using a remote control device;

(b) remotely manipulating one of said cleaning attachments so as to dislodge coal from beneath the conveyor belt; and (c) remotely manipulating the other of said cleaning attachments to deposit said dislodged coal onto the conveyor belt.

18. A remotely-operable vehicle adapted for use in cleaning within a mine environment, comprising:

(a) body having a front portion and a rear portion;

(b) at least one support arm pivotally supported at its distal end by said body;

(c) a drive system for moving the vehicle having at least one drive motor;

(d) a hydraulic system having a hydraulic fluid tank, a hydraulic fluid pump, and a plurality of hydraulic actuators;

(e) a receiver for receiving control signals from a remote control device for remotely operating the vehicle; and (f) a cleaning attachment attached to the vehicle at a proximal end of said at least one support arm and configured to be manipulated remotely by a user using a remote control device, said cleaning attachment comprising a grinder and a bucket, with said grinder located above and in front of said bucket and adapted to be transversely movable across at least a portion of the width of said bucket and pivotally movable away from said bucket, wherein said transverse and pivotal movement of the grinder can be independently and remotely controlled by an end user.

19. The vehicle of claim 1, wherein said at least one cleaning attachment comprises a grinder and a bucket, wherein said grinder and said bucket are attached to the vehicle such that the grinder is located above and in front of said bucket, said grinder adapted to be transversely movable across at least a portion of the width of said bucket and pivotally movable away from said bucket, such that said transverse and pivotal movement of the grinder can be independently and remotely controlled by a user using a remote control device.

20. The method of claim 17, wherein one of said cleaning attachments comprising a grinder used for dislodging coal, and the other cleaning attachment comprises a bucket for depositing dislodged coal onto the conveyor belt.

21. The method of claim 20, wherein the grinder is located above and in front of the bucket and is adapted to be transversely movable back and forth across at least a portion of the width of said bucket, and further wherein said step of remotely manipulating the grinder so as to dislodge coal from beneath the conveyor belt includes moving the grinder transversely across at least a portion of the width of the bucket.

* * * * *